US012152295B2

(12) United States Patent
Gong et al.

(10) Patent No.: US 12,152,295 B2
(45) Date of Patent: Nov. 26, 2024

(54) PRECIPITATION STRENGTHENED CARBURIZABLE AND NITRIDABLE STEEL ALLOYS

(71) Applicant: QUESTEK INNOVATIONS LLC, Evanston, IL (US)

(72) Inventors: Jiadong Gong, Evanston, IL (US); Ida Berglund, Evanston, IL (US); Amit Behera, Evanston, IL (US); Greg Olson, Evanston, IL (US)

(73) Assignee: QUESTEK INNOVATIONS LLC, Evanston, IL (US)

( * ) Notice: Subject to any disclaimer, the term of this patent is extended or adjusted under 35 U.S.C. 154(b) by 112 days.

(21) Appl. No.: 17/179,666

(22) Filed: Feb. 19, 2021

(65) Prior Publication Data

US 2021/0254202 A1 Aug. 19, 2021

Related U.S. Application Data

(60) Provisional application No. 62/978,752, filed on Feb. 19, 2020.

(51) Int. Cl.

| | |
|---|---|
| ***C22C 38/48*** | (2006.01) |
| ***C22C 38/42*** | (2006.01) |
| ***C22C 38/44*** | (2006.01) |
| ***C22C 38/46*** | (2006.01) |

(52) U.S. Cl.

CPC ..... *C22C 38/48* (2013.01); *C22C 38/42* (2013.01); *C22C 38/44* (2013.01); *C22C 38/46* (2013.01)

(58) Field of Classification Search

None

See application file for complete search history.

(56) References Cited

U.S. PATENT DOCUMENTS

| | | | |
|---|---|---|---|
| 6,176,946 | B1 | 1/2001 | Kuehmann et al. |
| 6,464,801 | B2 | 10/2002 | Kuehmann et al. |
| 6,485,582 | B1 | 11/2002 | Kuehmann et al. |
| 6,635,126 | B2 | 10/2003 | Kuehmann et al. |
| 6,699,333 | B1 | 3/2004 | Dubois |
| 8,801,872 | B2 | 8/2014 | Wright et al. |
| 9,045,806 | B2 | 6/2015 | Montagnon |

(Continued)

FOREIGN PATENT DOCUMENTS

| | | | | |
|---|---|---|---|---|
| EP | 2679698 | A1 * | 1/2014 | ..... C21D 1/18 |
| JP | 05093244 | A * | 4/1993 | |

(Continued)

OTHER PUBLICATIONS

English language machine translation of JP-05093244-A to Nakazato et al. Generated Dec. 9, 2022. (Year: 2022).*

(Continued)

*Primary Examiner* — Brian D Walck

(74) *Attorney, Agent, or Firm* — Michael Best & Friedrich LLP

(57) ABSTRACT

Materials, methods and techniques relate to steel alloys. In some instances, steel alloys can include chromium, molybdenum, vanadium, copper, nickel, manganese, niobium, aluminum, and iron. In some instances, exemplary steel alloys are subjected to solution carburizing, tempering, and/or plasma nitriding. Exemplary steel alloys are typically precipitation strengthened carburizable and nitridable steel alloys.

19 Claims, 18 Drawing Sheets

(56) References Cited

U.S. PATENT DOCUMENTS

| | | | | |
|---|---|---|---|---|
| 2011/0036463 | A1* | 2/2011 | Miyanishi | C21D 9/32 148/319 |
| 2012/0018050 | A1 | 1/2012 | Kubota et al. | |
| 2015/0114525 | A1* | 4/2015 | Valls | C22C 38/22 148/612 |
| 2015/0118098 | A1* | 4/2015 | Valls | C22C 38/28 420/101 |
| 2016/0122841 | A1* | 5/2016 | Koyama | C22C 38/50 148/328 |
| 2017/0282501 | A1* | 10/2017 | Kubota | C23C 8/80 |

FOREIGN PATENT DOCUMENTS

| | | | |
|---|---|---|---|
| JP | 2008075136 | A | 4/2008 |
| JP | 2019143197 | A | 8/2019 |

OTHER PUBLICATIONS

Heuer, Volker. "Low-Pressure Carburizing." ASM Handbook, vol. 4A, Steel Heat Treating Fundamentals and Processes. J. Dossett and G.E. Totten, editors. 2013. pp. 581-590. (Year: 2013).*

Elwart et al. "Plasma (Ion) Nitriding and Nitrocarburizing of Steels." ASM Handbook, vol. 4A, Steel Heat Treating Fundamentals and Processes. J. Dossett and G.E. Totten, editors. 2013. pp. 690-703. (Year: 2013).*

"Hardness Conversion Chart." Carbide Depot. http://www.carbidedepot.com/formulas-hardness.htm. Accessed Jun. 16, 2023. (Year: 2023).*

Roelandt et al., "Plasma Nitriding of Gear Wheels in Mass Production", Surface Engineering, vol. 1, No. 3, 1985, pp. 187-192.

Tobie et al., "Optimizing Gear Performance by Alloy Modification of Carburizing Steels", Metals 2017, vol. 7, 415, pp. 1-20.

Ovako, "Material data sheet steel grade, 16CRMnNiMo9-5-2", <https://steelnavigator.ovako.com/steel-grades/16crmnnimo9-5-2>, retrieved Nov. 2019, 7 pages.

Ghosh et al., "Kinetics of FCC-BCC heterogeneous martensitic nucleation the critical driving-force for athermal nucleation", Acta Metallurgica et Materialia, vol. 42, No. 10, 1994, pp. 3361-3370.

Tiemens, "Performance Optimization and Computational Design of Ultra-High Strength Gear Steels", PhD dissertation submitted to Northwestern University, Dec. 2006, 209 pages.

Tiemens et al., "Cu-precipitation strengthening in ultrahigh-strength carburizing steels." Metallurgical and Materials Transactions A, vol. 43, No. 10, 2012, pp. 3615-3625.

European Patent Office Extended Search Report for Application No. 21158133.5 dated Jun. 17, 2021 (7 pages).

Japanese Patent Office Notice of Reasons for Refusal for Application No. 2021-025405 dated Sep. 26, 2022 (9 pages with English translation).

European Patent Office Exam Report for Application No. 21158133.5 dated Jul. 18, 2022 (4 pages).

* cited by examiner

PRECIPITATION STRENGTHENED CARBURIZABLE AND NITRIDABLE STEEL ALLOYS

CROSS-REFERENCE TO RELATED APPLICATION

The present application is related to and claims the priority benefit of U.S. Provisional Patent Application No. 62/978,752, filed Feb. 19, 2020, the entire contents of which are incorporated herein by reference.

TECHNICAL FIELD

The present disclosure relates to materials, methods and techniques for manufacturing steel alloys. More particularly, the instant disclosure relates to precipitation strengthened carburizable and nitridable steel alloys. Exemplary steel alloys disclosed and contemplated herein may be particularly suited for manufacturing gears and shafts.

INTRODUCTION

Gear steels can be generally described by their relatively low alloy content (i.e., "lean" in alloy content), and can be carburized, nitrided or carbonitrided to achieve property requirements of high surface hardness. Surface hardened gear steels typically include a case-hardened layer that contributes to the wear resistance and a core of the gear that helps improve toughness. A property of interest for this class of steels is fatigue performance, specifically bending and Hertzian contact fatigue. In addition, core material yield strength and fracture toughness can be useful to resist overload fracture. Another property of interest is resistance to strength loss at operating temperatures in the range of 50-200° C. Because of the high production volume of material necessary for gear steel applications, maintaining low alloy cost (including material and processing costs) is also a criterion.

Some high-performance gear steel alloys include cobalt to suppress the recovery of the dislocations and thus promote improved secondary precipitation hardening during tempering. However, with increasing price and unreliable sourcing of cobalt, the instant disclosure is directed to cobalt-free alloys with similar properties as available cobalt-containing high-performance gear steels. Broadly, the instant disclosure utilizes copper instead of cobalt to aid $M_2(C,N)$ carbide precipitation strengthening in ultrahigh-strength carburizing/carbonitriding steel and achieve a lower alloy cost. The computationally designed alloy compositions are free of cobalt, with minimal additions of expensive elements Ni, V, and Mo.

In addition to high temperature carburizing treatments, low temperature nitriding (such as plasma nitriding) is an efficient method to promote precipitation of additional hardening phases in the case layer of the gear steels. The process results in formation of hard nitrides of specific alloying elements such as Al, Ti, Cr, Mo, V found in gear steels. The nitriding process results in improved fatigue resistance because of compressive stresses generated and the strengthening nitrides are usually stable until higher temperatures (~500° C.) compared to carbides.

SUMMARY

In one aspect, an alloy is disclosed. An example alloy may comprise, by weight percentage, 3.0% to 8.0% chromium; 0.02% to 5.0% molybdenum; 0.1% to 1.0% vanadium; 0.5% to 2.5% copper; 0.5% to 2% nickel; 0.2% to 0.4% manganese; 0.01% to 0.05% niobium; 0.1% to 1.0% aluminum and the balance iron and incidental elements and impurities.

In another aspect, a method for making an alloy is disclosed. An example method may comprise preparing a melt, comprising by weight percentage, 3.0% to 8.0% chromium; 0.02% to 5.0% molybdenum; 0.1% to 1.0% vanadium; 0.5% to 2.5% copper; 0.5% to 2% nickel; 0.2% to 0.4% manganese; 0.01% to 0.05% niobium; 0.1% to 1.0% aluminum and the balance iron and incidental elements and impurities. The method may also comprise solution carburizing the melt at a temperature of 1000° C. to 1150° C. for 1 hour to 8 hours followed by quenching; and after quenching, either plasma nitriding at 450° C. to 550° C. or tempering the alloy at 450° C. to 550° C.

There is no specific requirement that a material, technique or method relating to steel alloys include all of the details characterized herein, in order to obtain some benefit according to the present disclosure. Thus, the specific examples characterized herein are meant to be exemplary applications of the techniques described, and alternatives are possible.

Calculations were performed with commercial database TCFE9 with kinetically less favored carbide phases excluded (e.g., $M_7C_3$, $M_{23}C_6$, $M_3C_2$).

Figure 7:
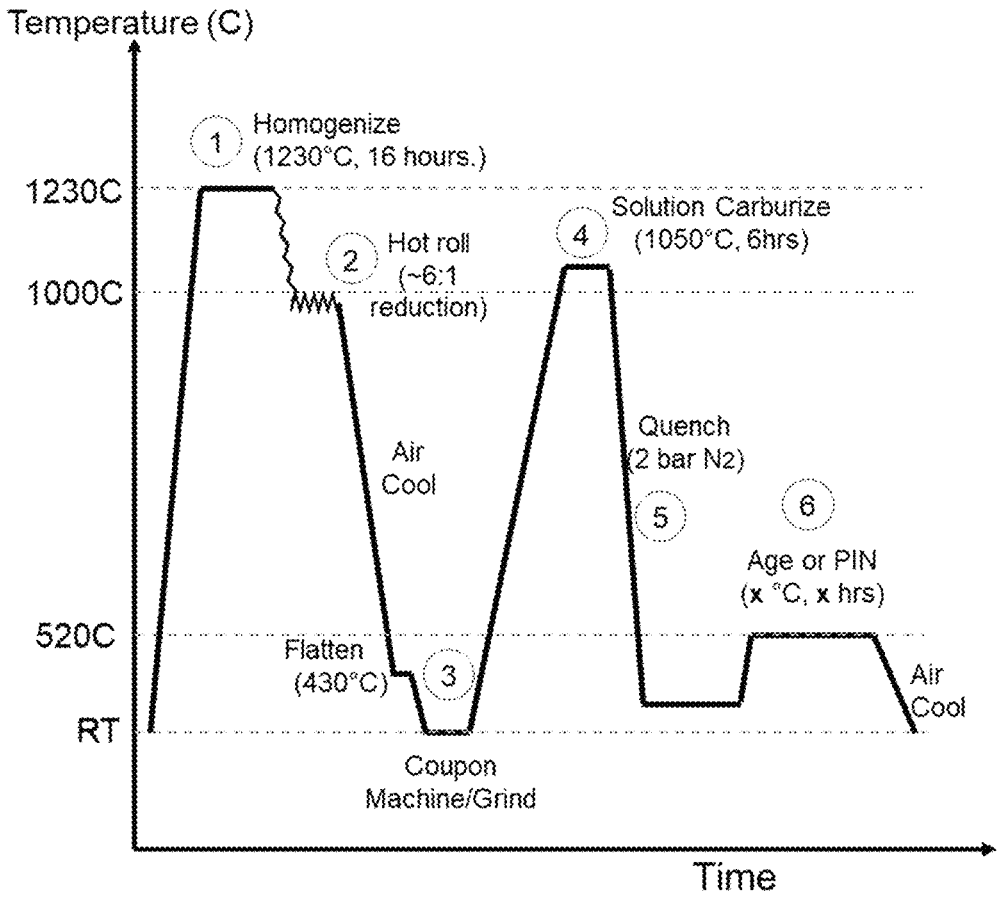

FIG. 7 shows a time-temperature schematic for processing involved in generating an experimental alloy.

Figure 8:
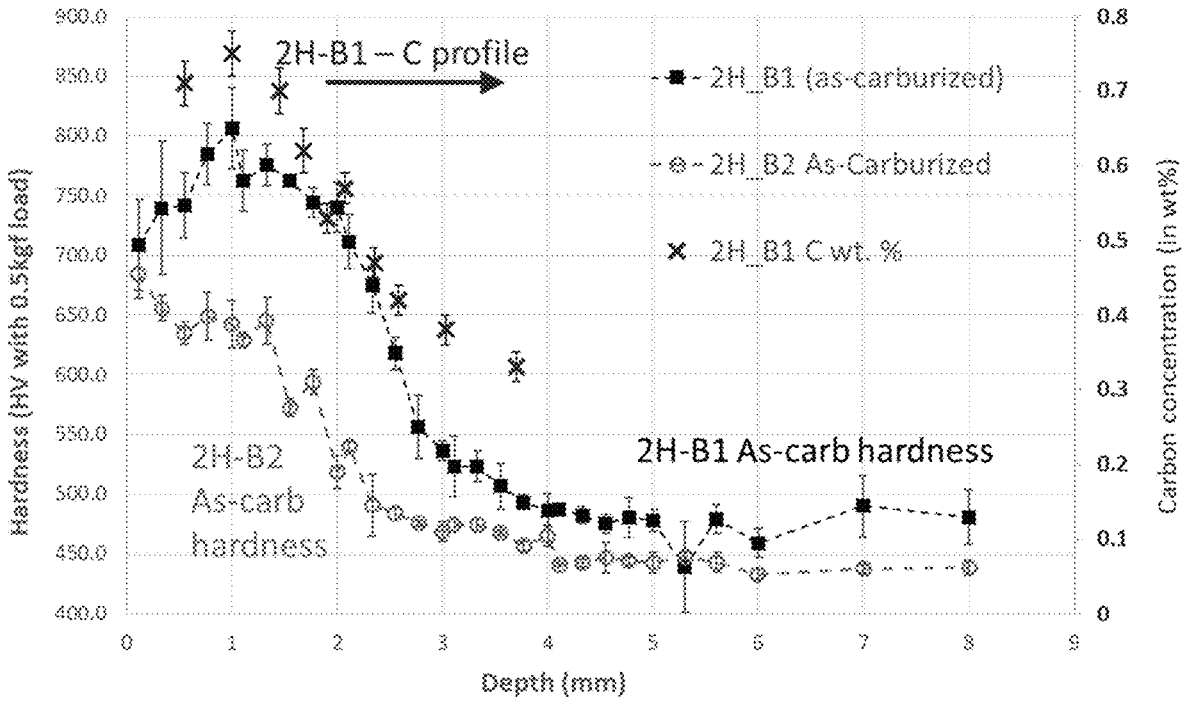

FIG. 8 shows cross sectional hardness profile for as-carburized 2H alloy using two different carburization cycles (B1 and B2). Also shown in FIG. 8 is the measured carbon content at different case depths.

Figure 9:
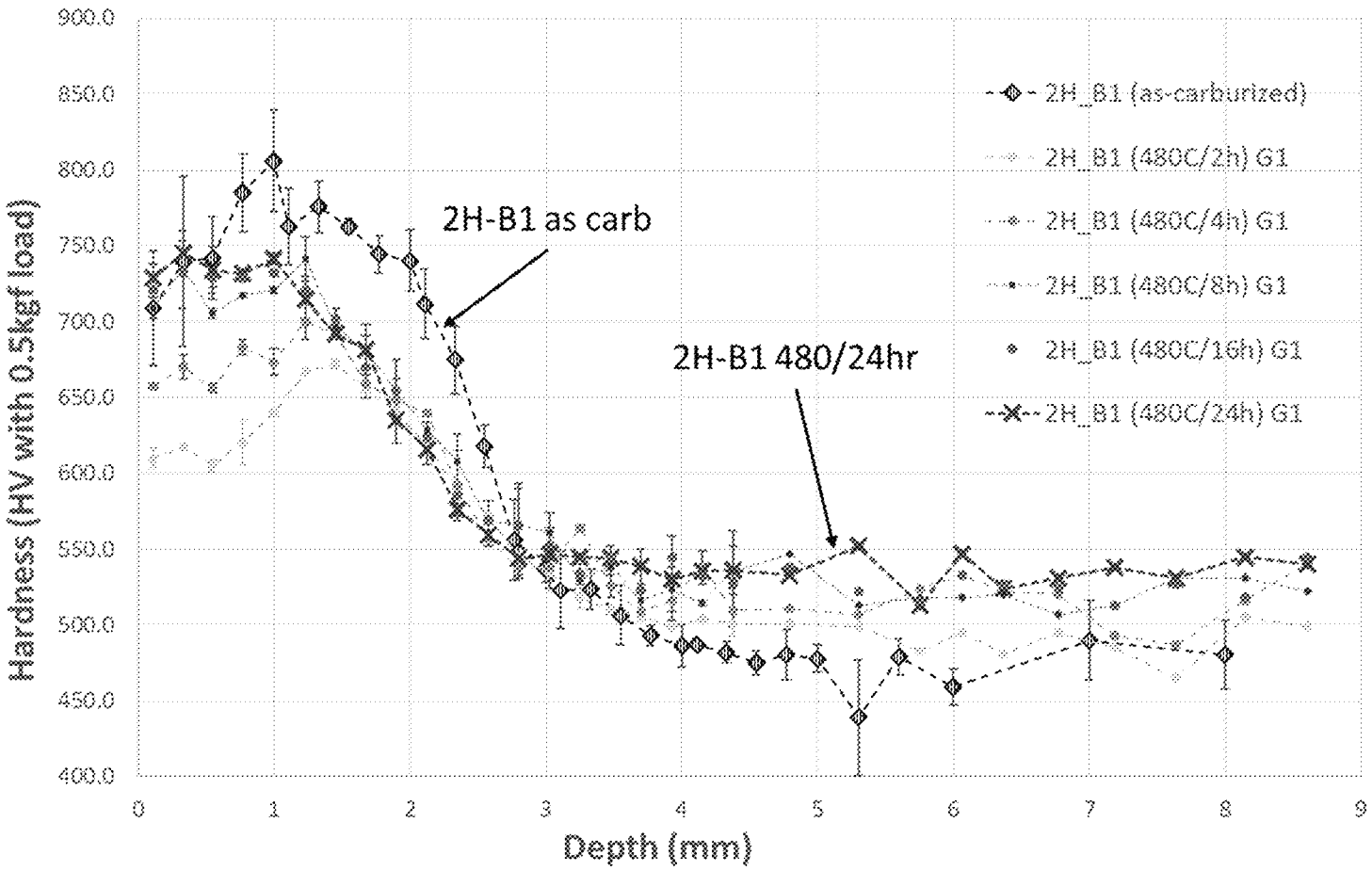

FIG. 9 shows cross sectional hardness profiles for 2H alloys carburized as per 2H-B1 carburization cycle and aged for different times at 480° C.

Figure 10:
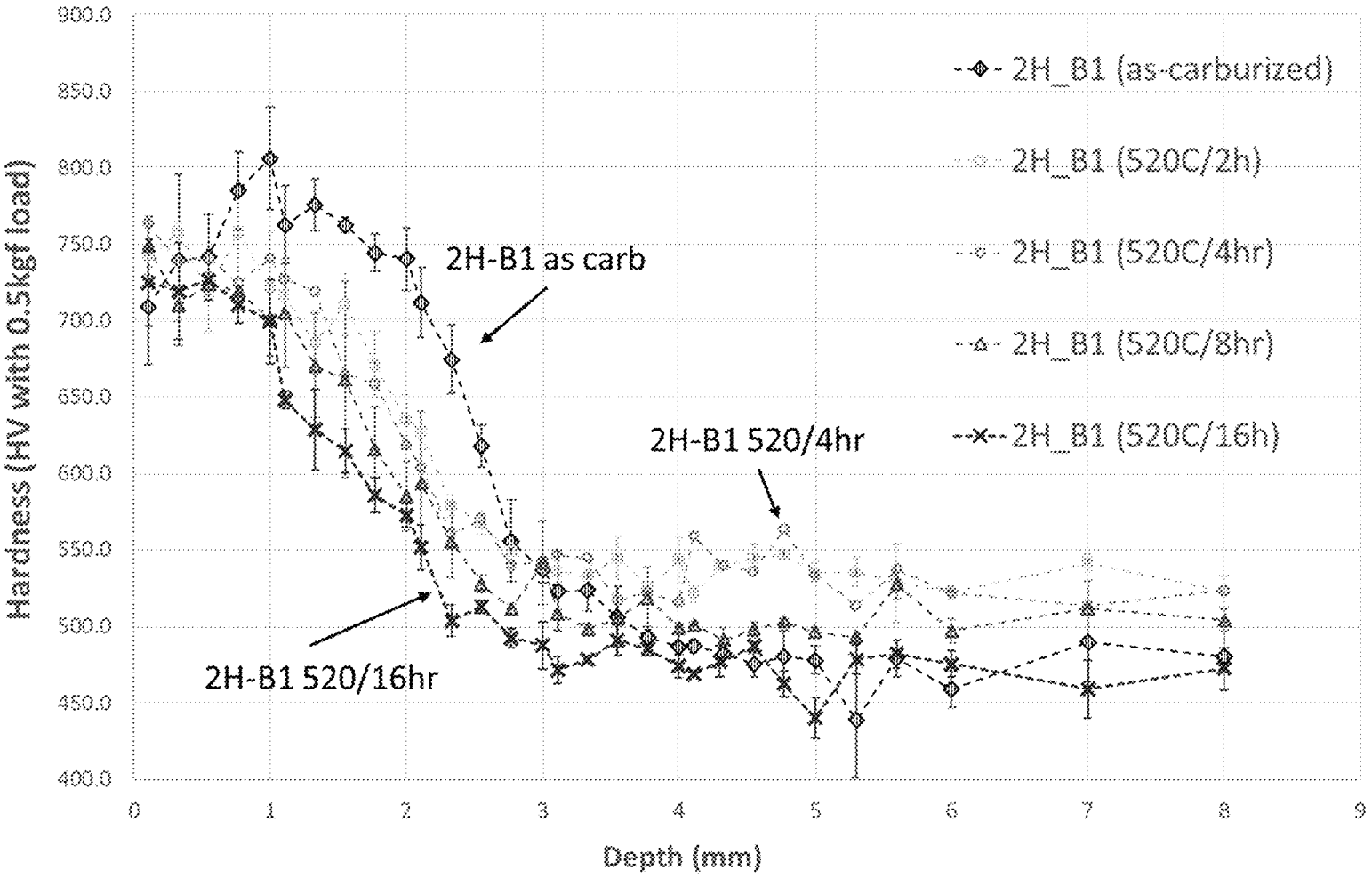

FIG. 10 shows cross sectional hardness profiles for 2H alloys carburized as per 2H-B1 carburization cycle and aged for different times at 520° C.

Figure 11:
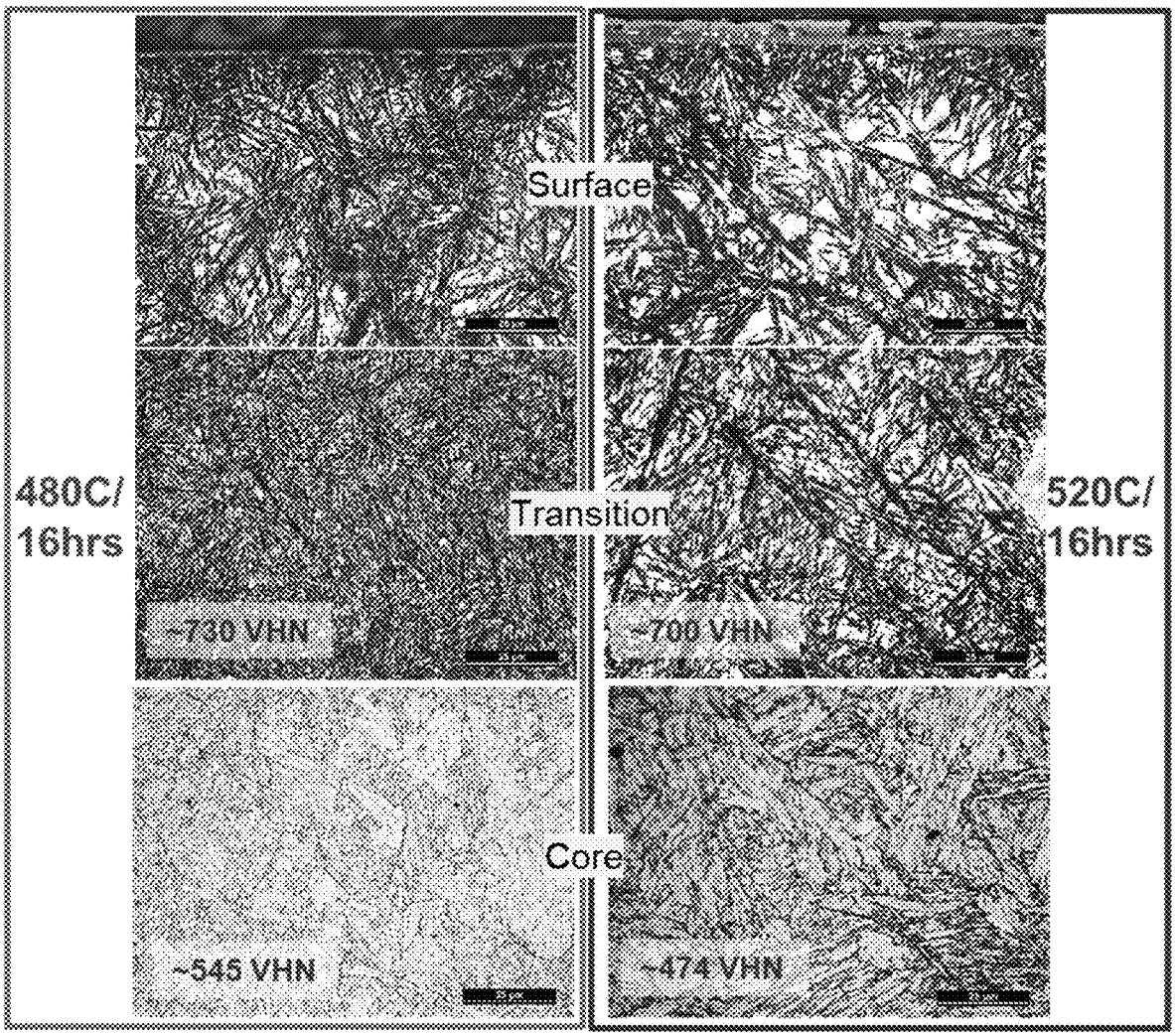

FIG. 11 shows cross sectional optical micrographs for 2H-B1 carburized sample aged at two different aging temperatures.

Figure 12:
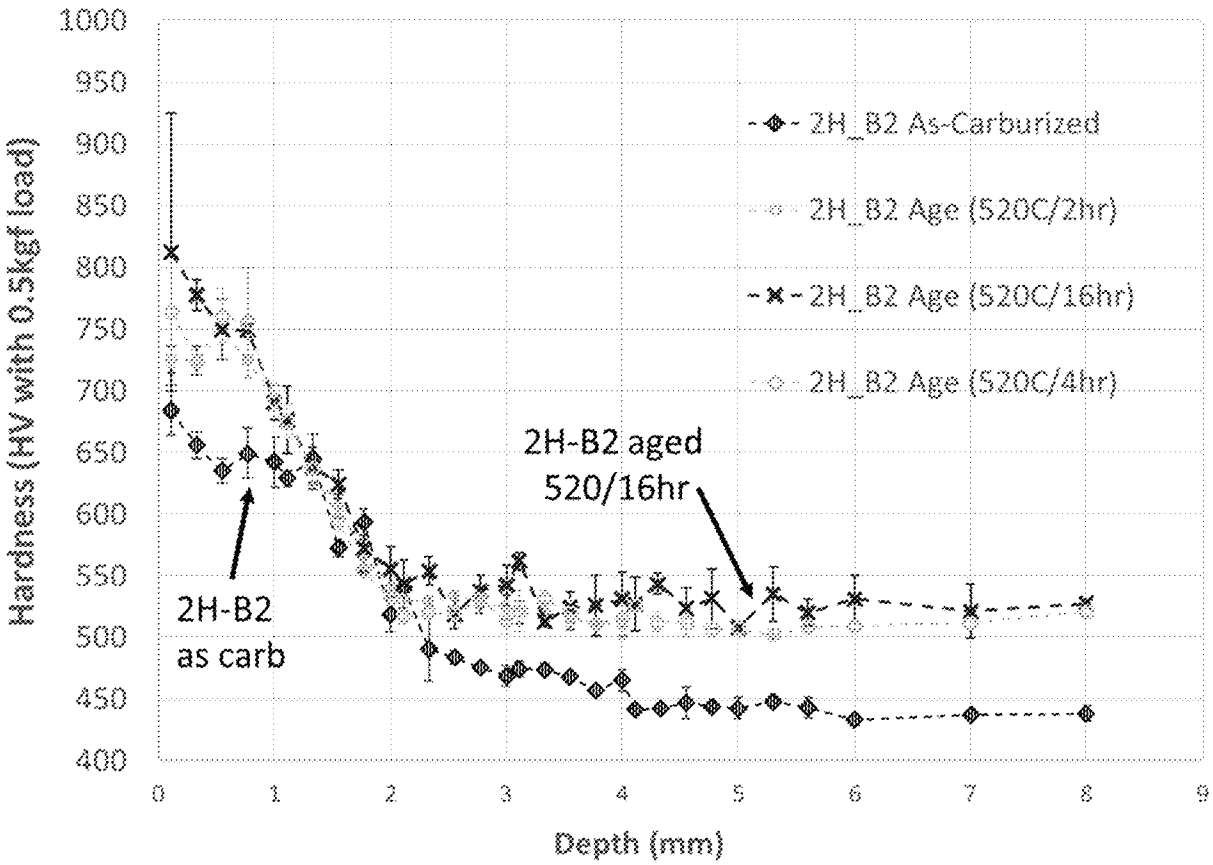

FIG. 12 shows cross section hardness profile for 2H alloy carburized as per 2H-B2 carburization cycle and aged for different times at 520° C.

Figure 13:
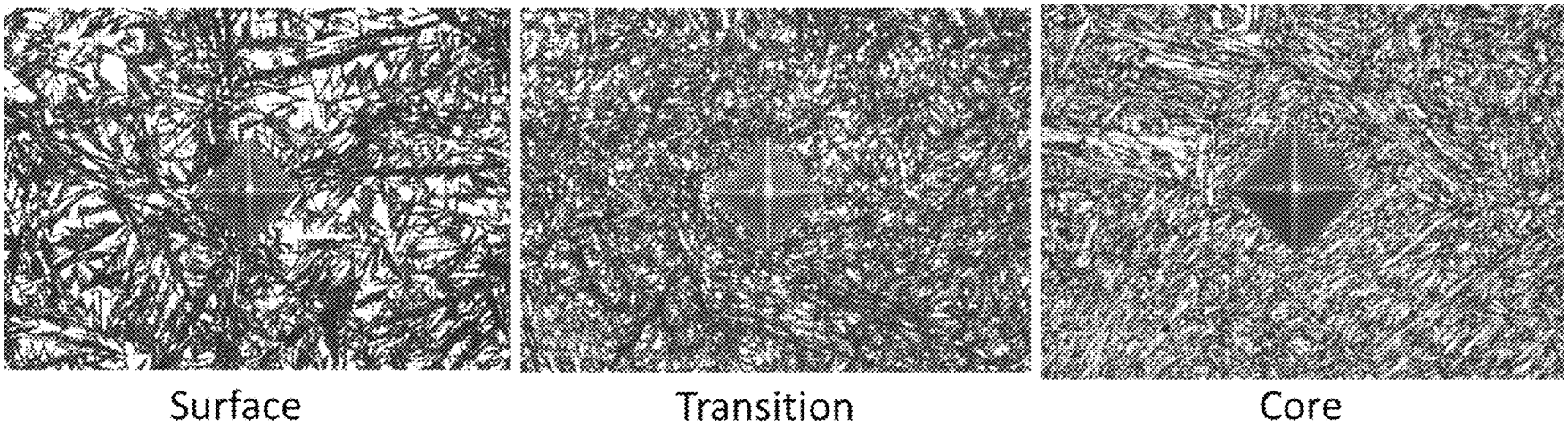

FIG. 13 shows optical micrographs of the microstructure of the case region close to surface, in the transition region (~1 mm from surface), and in the core (>2.5 mm from surface) after aging at 520° C. for 16 hours, for the 2H-B2 alloy.

Figure 14:
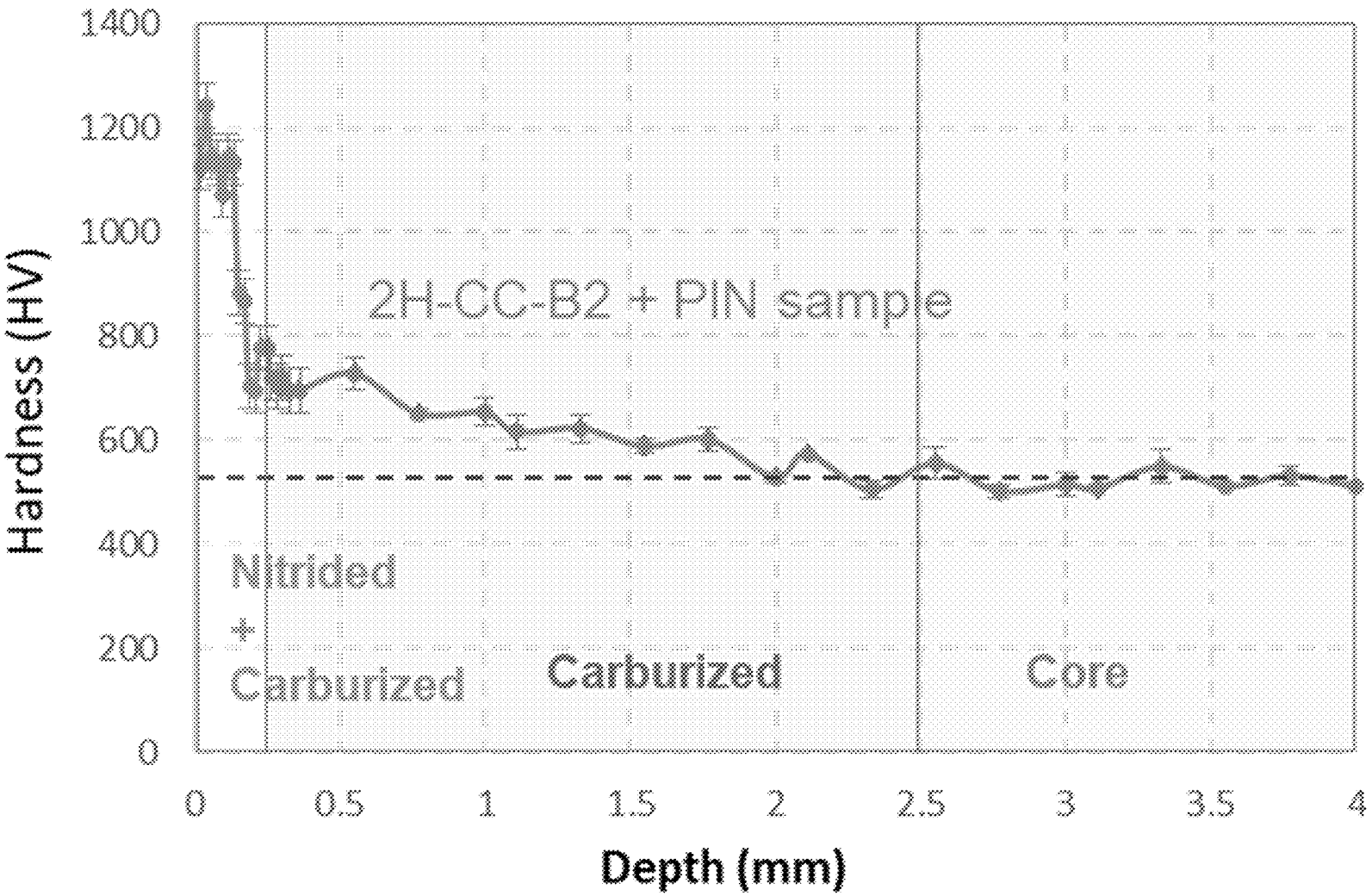

FIG. 14 shows cross sectional hardness profile for 2H-CC-B2+PIN sample showing the increased surface hardness compared to core region.

Figure 15:
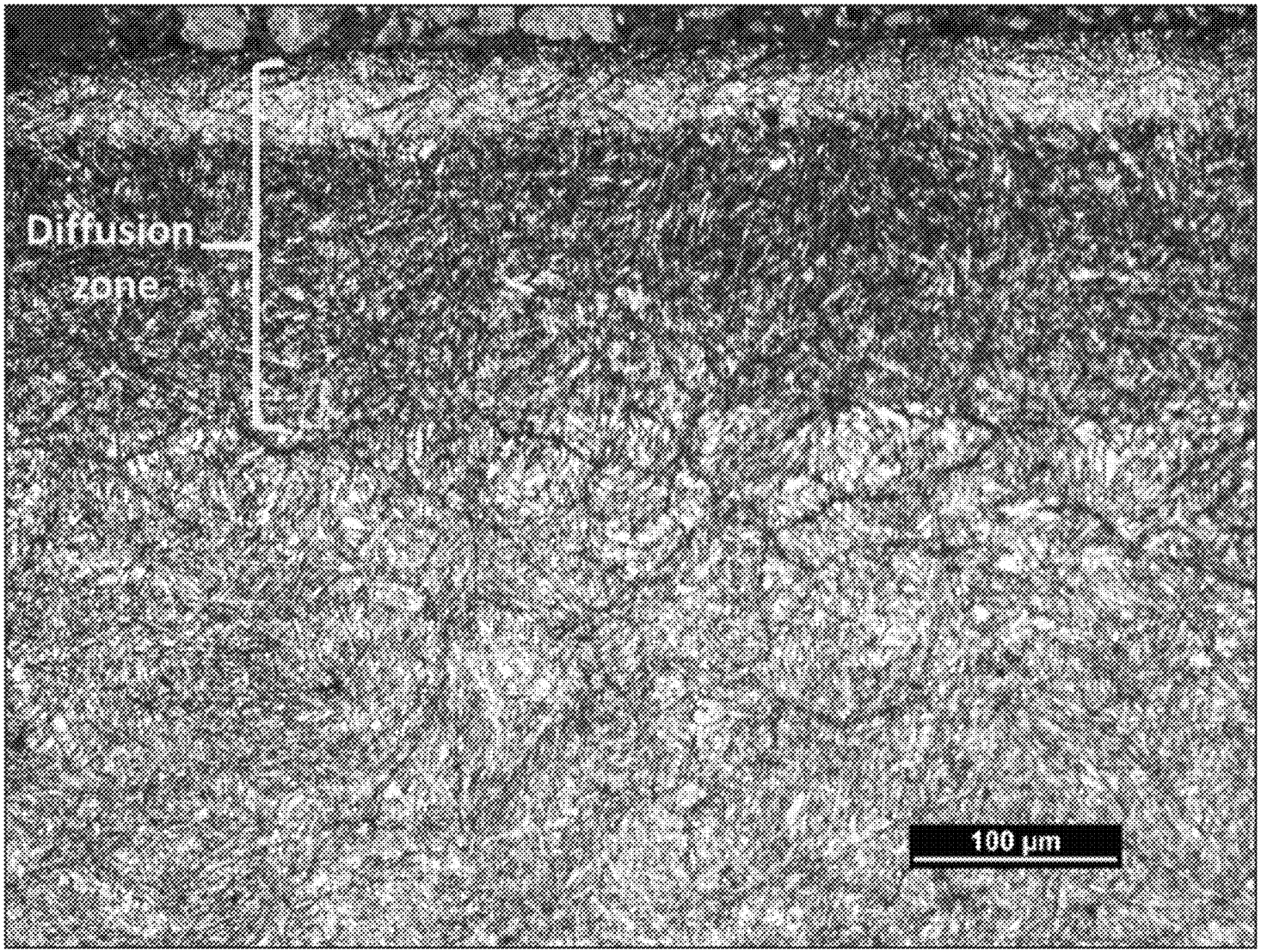

FIG. 15 shows an optical micrograph of the diffusion zone of a 2H-CC-B2+PIN sample.

Figure 16:
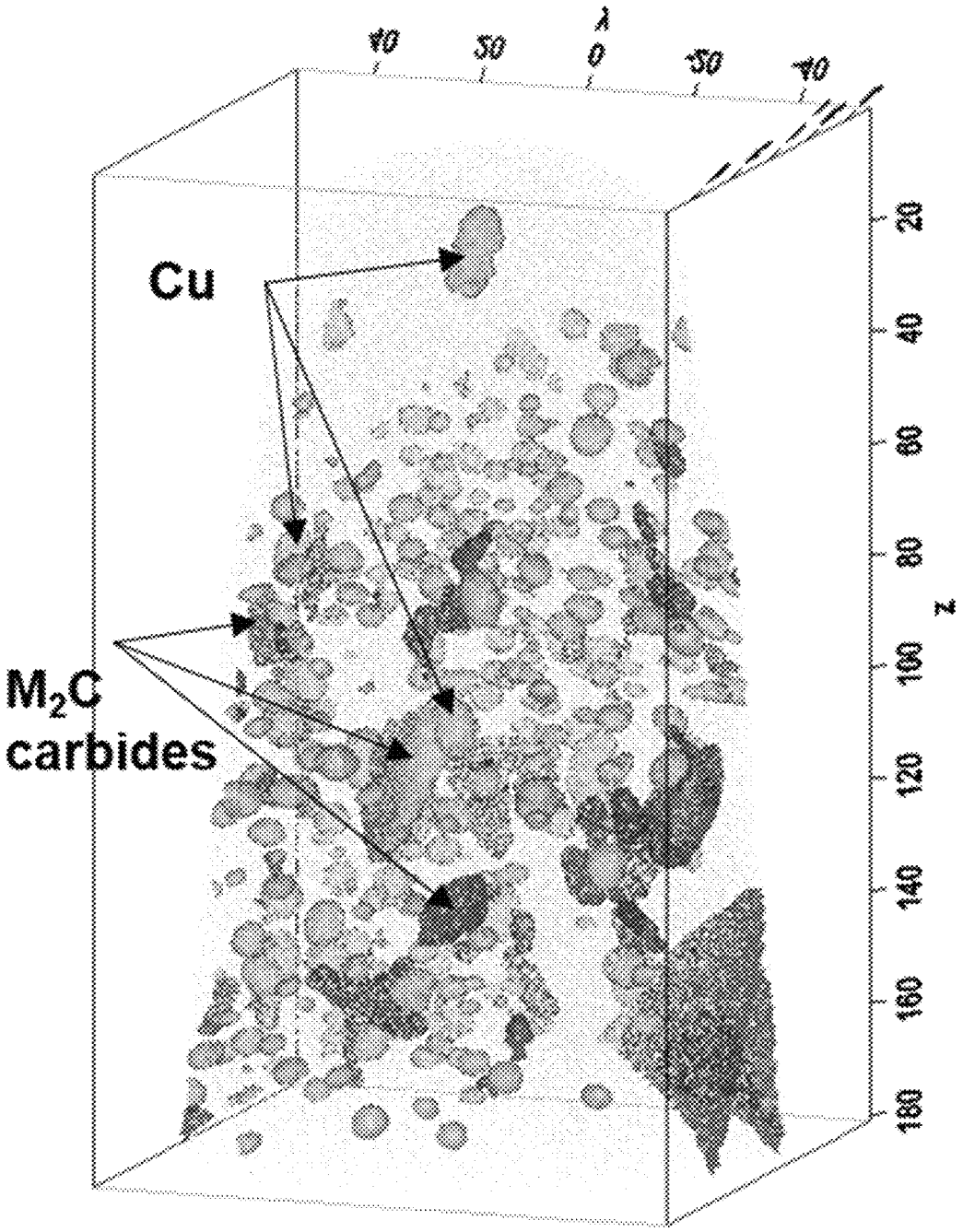

FIG. 16 is a three-dimensional atom probe tomography reconstruction showing phase distribution in the case region of 2H-CC-B2 carburized and 520° C./16 hour aged sample. The Cu particles are outlined with a 4.5 wt % iso-concentration surface while the carbide phase is outlined by a 7.5 wt % iso-concentration surface.

Figure 17:
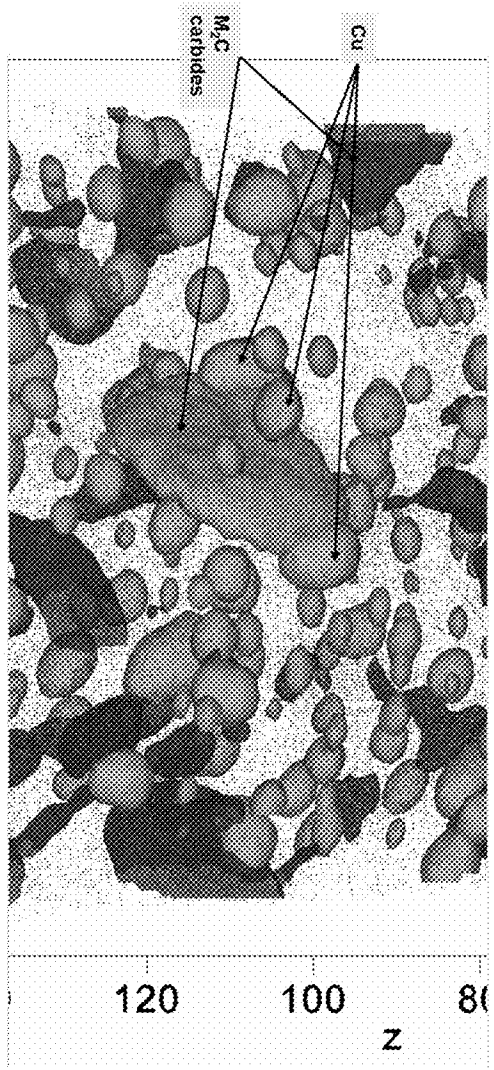

FIG. 17 shows a magnified portion of the three-dimensional atom probe tomography shown in FIG. 16.

Figure 18:
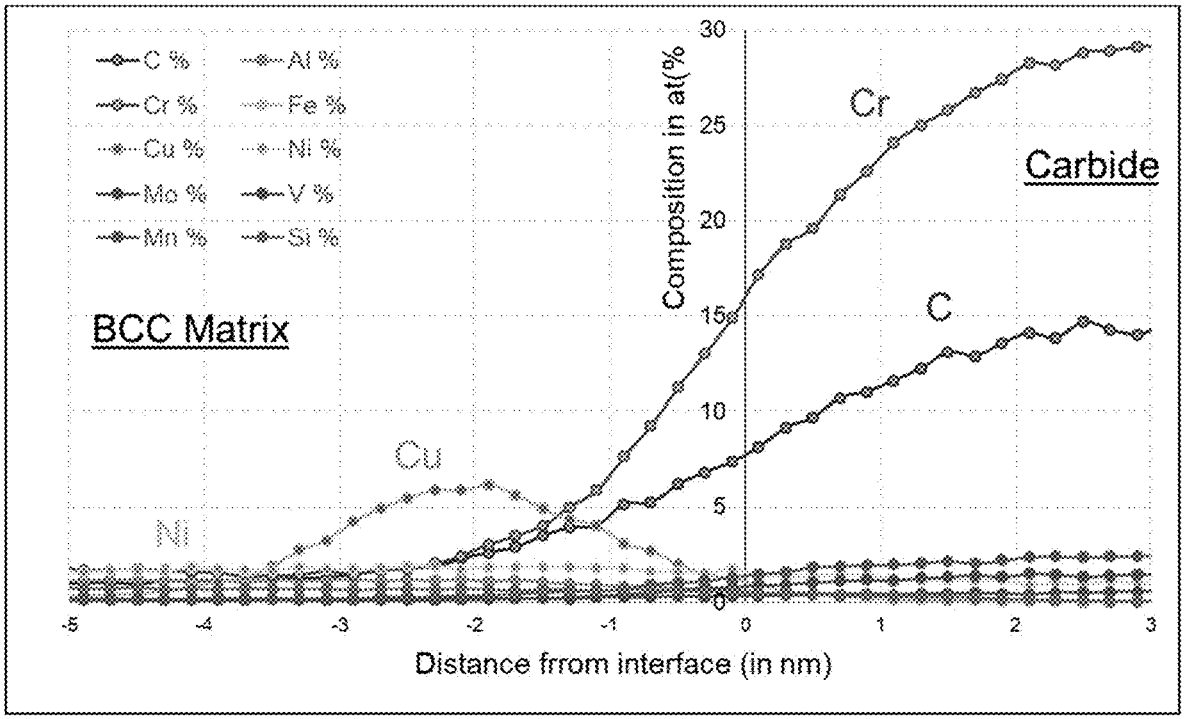

FIG. 18 shows a proximity histogram for the composition of carbides shown in FIG. 16.

DETAILED DESCRIPTION

Materials, methods and techniques disclosed and contemplated herein relate to steel alloys. More particularly, the instant disclosure is directed to nano-carbide precipitation strengthened carburizable and nitridable steel alloys. Secondary hardening can be utilized in combination with copper (Cu) addition for precipitation strengthening and aiding of nucleation of $M_2C$ carbides. Typically, exemplary steel alloys disclosed herein do not include cobalt, or include less than 0.001 wt % Co.

Generally, exemplary alloy microstructure can be primarily martensitic with addition of BCC-Cu precipitates and $M_2X$ nanoscale carbides, nitrides or carbonitrides where M is one or more element selected from the group including Mo, Nb, V, Ta, W, Cr and X is C and/or N. The composition, size, fraction and distribution of these precipitates can impact the alloy mechanical characteristics.

Usually, precipitates are present mostly in the form of $M_2X$ and to some extent, MX, without the presence of other larger sized precipitates. The precipitates can have a size (average diameter) that is less than about ten nanometers. In some instances, precipitates have an average diameter that is in the range of about three nanometers to five nanometers. Usually, exemplary alloys do not include other larger scale incoherent carbides such as cementite, $M_{23}C_6$, $M_6C$ and $M_7C_3$. Other embrittling phases, such as topologically close packed (TCP) intermetallic phases, are also usually avoided.

Exemplary alloys may also include AlN precipitates formed after the nitriding processing treatment. Aluminum nitride, a highly effective strengthening phase, can provide good case hardening because AlN has high thermodynamic stability and readily forms in the case layer upon plasma nitriding of Al-containing steels. The addition of Al may also contribute to solid solution strengthening and may slightly increase the driving force for precipitation of $M_2C$ carbides.

Exemplary alloy compositions may include a balance of solute elements to maintain a sufficiently high Martensite start (Ms) temperature to ensure complete martensite formation after solution carburization followed by quenching, achieve adequately high driving force for $M_2C$ precipitation, and/or provide ample nucleation sites (dislocations and Cu precipitates) for precipitation of the nanoscale carbides. Resistance to cleavage can be enhanced by appropriate Ni addition and promoting grain refinement through stable MC carbide dispersions which resist coarsening at the normalizing or solution treatment temperature. Further case hardening can be promoted with addition of Al to form AlN precipitates in the case layer. Exemplary alloy compositions and thermal processing can be optimized to minimize or eliminate other dispersed particles that may limit toughness and fatigue resistance. Exemplary alloy compositions can be constrained to limit microsegregation under production-scale ingot solidification conditions.

I. EXAMPLE DESIGN CONSIDERATIONS

Exemplary aspects of steel alloys disclosed herein may relate to one or more example design considerations. For instance, one design consideration relates to utilizing secondary hardening for high hardness and copper (Cu) addition for precipitation strengthening and aiding the nucleation of $M_2C$ carbides. Nanoscale BCC-Cu precipitates form during aging and contribute to alloy strength and additional $M_2C$ nucleation sites provided by the Cu precipitates enhances the aging response. The Cu also assists with short-range ordering, retarding dislocation recovery. The amount of Cu addition needs to be carefully controlled to provide adequate nucleation sites especially in the case carburized regions where high number density of carbide precipitates is desirable. Excess Cu addition could increase alloy cost due to its cost and cost of additional Ni to maintain at least 0.5 ratio of Ni/Cu to prevent hot shortness issues.

Another example design consideration is ensuring proper balance of alloying addition to maximize $M_2C$ driving force to achieve efficient precipitation. High hardness and strength can be controlled by adding carbide formers such as Cr, Mo, and V. In order to achieve desired hardness and strength levels, the thermodynamic driving force for $M_2C$ carbide precipitation should be maximized. This is balanced against processing considerations, such as the required solution carburizing temperature and microsegregation behavior which increase with increased alloying, aiming to minimize processing time and temperature. It appears that the hardness of the alloy can be dependent on the phase fraction and size of the $M_2C$ carbides achievable through the heat treatment processing.

Another example design consideration is optimizing Cr, Mo and V content for maximizing the $M_2(C,N)$ driving force (DF), while maintaining sufficiently high Ms temperature, as well as a defined M:(C+N) atomic ratio. Maintaining a sufficiently high Ms temperature may ensure complete transformation to lath martensite, which not only exhibits superior toughness over plate martensite, but is also a highly-dislocated structure conducive to heterogeneous nucleation of $M_2C$ carbides. Another consideration in balancing the hot shortness, Ms and toughness, is to avoid formation of embrittling phases (e.g. TCP, Sigma phase), ensuring they are thermodynamically unstable. The ratio of carburization level to nitriding level (C:N ratio) is decided based on the strengthening due to carbides versus nitride/carbonitrides and the difference in hardening depth achievable via high temperature carburization vs low-temperature nitriding treatment.

Another example design consideration is optimizing the case carburization level and nitriding level to maximize surface hardness. This can include managing the difference in hardness between the surface carburized and nitride layer and the carburized layer below it. In addition to Cr, Mo, and V, another potent nitride-forming element, aluminum, can added to further improve surface hardness through formation of AlN phase during the nitriding process. The plasma nitriding level can be decided based on the amount of available 'M' elements after taking into account those bound in form of $M_2C$ precipitates and accounting those needed for formation of highly stable AlN strengthening precipitates. Alloys can be subjected to solution carburization followed by quenching to room temperature and then directly plasma nitrided to form a shallow high hardness case nitrided layer (consisting of $M_2(C,N)$, Cu and AlN precipitates) with an underlying deeper carburized case layer (consisting of $M_2C$ and Cu precipitates) and the core consisting of Cu precipitates with smaller fraction of nanoscale carbides.

Exemplary properties and processing constraints are quantified in terms of several design parameters as tabulated in Table 1. The computational tools/models used to predict these design parameters are also listed alongside in Table 1.

TABLE 1

Summary of tools used to model various design parameters.

| Parameter | Model/Tool used and desired target |
|---|---|
| Case hardness<br>Core hardness | QuesTek-developed strength model along with thermodynamic calculations to maximize case layer hardness |
| Case Ms<br>Core Ms | Olson-Ghosh model using QuesTek developed database to ensure complete martensitic microstructure in case layer. G. Ghosh and G. B. Olson. Kinetics of FCC-BCC heterogeneous martensitic nucleation the critical driving-force for athermal nucleation. Acta Metallurgica et Materialia, 42(10):3361-3370, 1994. |
| $T_{sol}$ | Thermo-Calc, TCFE9 and other QuesTek databases to ensure complete solubility of carbon in austenite phase during carburization |
| Ni/Cu | Calculated atomic ratio to avoid hot shortness issues |
| Driving force for $M_2(C,N)$ phases | QuesTek-developed model + database to maximize precipitation strengthening |
| Alloy material cost | Metals price from London Metals Exchange (LME) for a cost-effective alloy |

II. EXEMPLARY ALLOYS

A. Exemplary Alloy Modeling

During initial development, a defined target surface hardness level (equal to 700 HV) was initially used to determine the required carburization level and necessary copper additions. The Vickers hardness is measured according to the standard ASTM E92-17 method for metallic materials. The matrix composition was then iteratively optimized to obtain appropriate Ni content for targeted martensite start temperature (Ms), cleavage resistance, hot shortness control, and the optimization of the strengthening dispersion, setting the Cr, Mo and V contents. These elemental additions influence the $M_2C$ driving force, solution carburizing temperature and microsegregation.

Hardness of exemplary alloys was predicted using developed models at QuesTek that utilize previous data from Ferrium C61, C64, C67, C70 alloys, as well as the Cu designs based on work reported by Tiemens et al. Tiemens, Benjamin Lee. "Performance Optimization and Computational Design of Ultra-High Strength Gear Steels." (2006); Tiemens, Benjamin L., Anil K. Sachdev, and Gregory B. Olson. "Cu-precipitation strengthening in ultrahigh-strength carburizing steels." Metallurgical and Materials Transactions A 43.10 (2012): 3615-3625.

Figure 1:
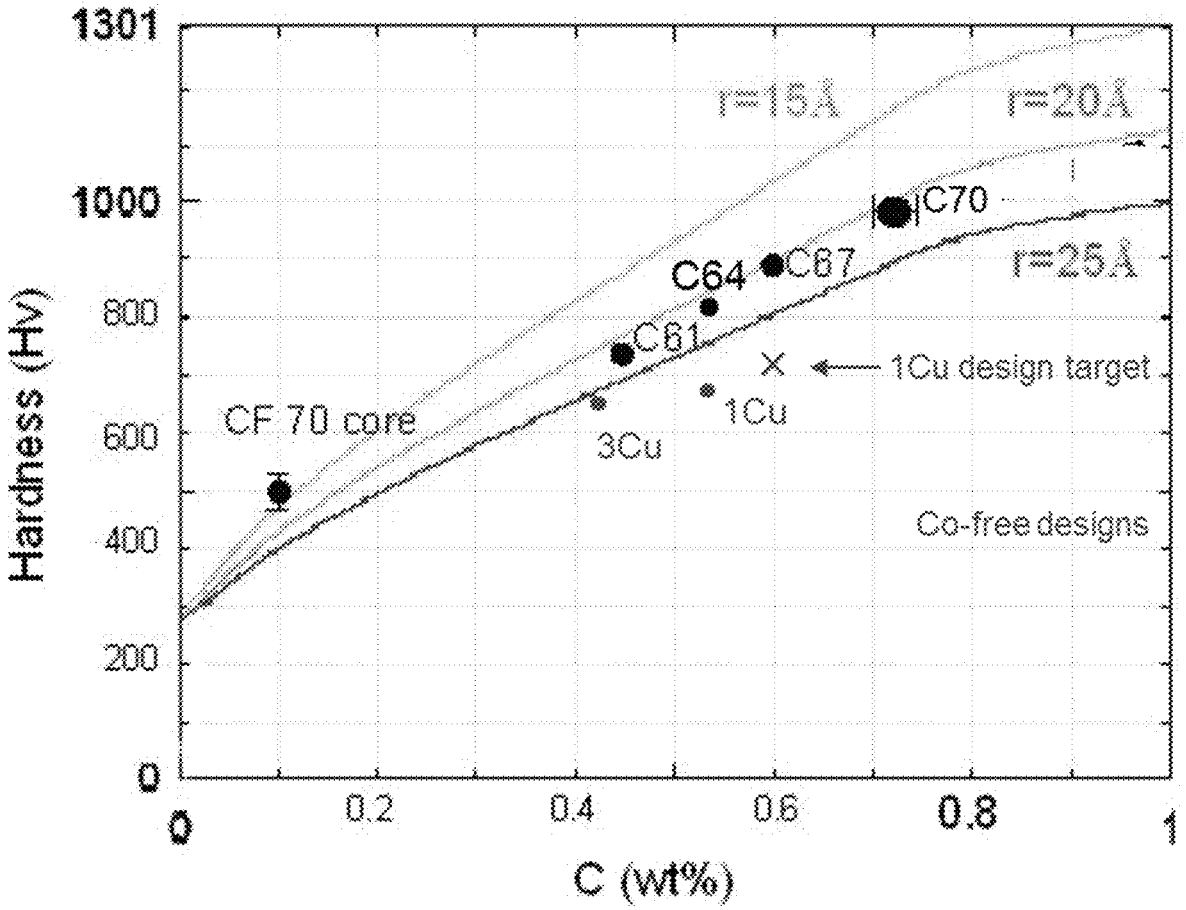
FIG. 1 shows measured and predicted hardness values (black and blue dots) as a function of carbon (C) content for $M_2C$-strengthened martensitic steels of varying particle radii, and identified target copper (Cu) and corresponding C levels for cobalt-free designs (blue x). The Co-containing alloys (C61, C64, C67, C70) are also plotted to provide reference to the achievable strength levels for different $M_2C$ radius.

The case hardness levels reported for different steels as a function of their case carbon levels and experimentally observed radius of strengthening carbide precipitates is plotted in FIG. 1. For low cost gear alloy designs, preexisting data suggests a Cu content of 1 wt % with a case carburization of 0.6 wt. % C would be sufficient to achieve target hardness in excess of 700HV with precipitate sizes likely larger than 25 Å. The usage of subsequent nitriding treatments may result in further hardness improvement.

Carburization-level and solution carburizing temperature were designed so that the system remains in the single phase FCC-austenite region during the solution carburizing step to enable maximum C intake into FCC phase that would maximize carbide precipitation during subsequent aging treatment. Another consideration is to limit the solution carburizing temperature within the large industrial furnace capabilities/limitations, which is assumed to be about 1100° C. Another consideration is to avoid formation of any primary carbides during solution carburizing because, in addition to being deleterious to mechanical properties, they consume carbon and carbide forming elements that are needed for the $M_2C$ strengthening precipitates. In the interest of reducing processing costs, it can be desirable to keep the solution carburizing temperature within the current production furnace capabilities and at short time durations (within a few hours at temperature). As an example and without limitation, based on the above defined conditions/constraints and the use of ICME tools, 0.6 wt. % case C level was determined as a case carbon level with solution carburizing temperature of 1100° C.

Figure 2:
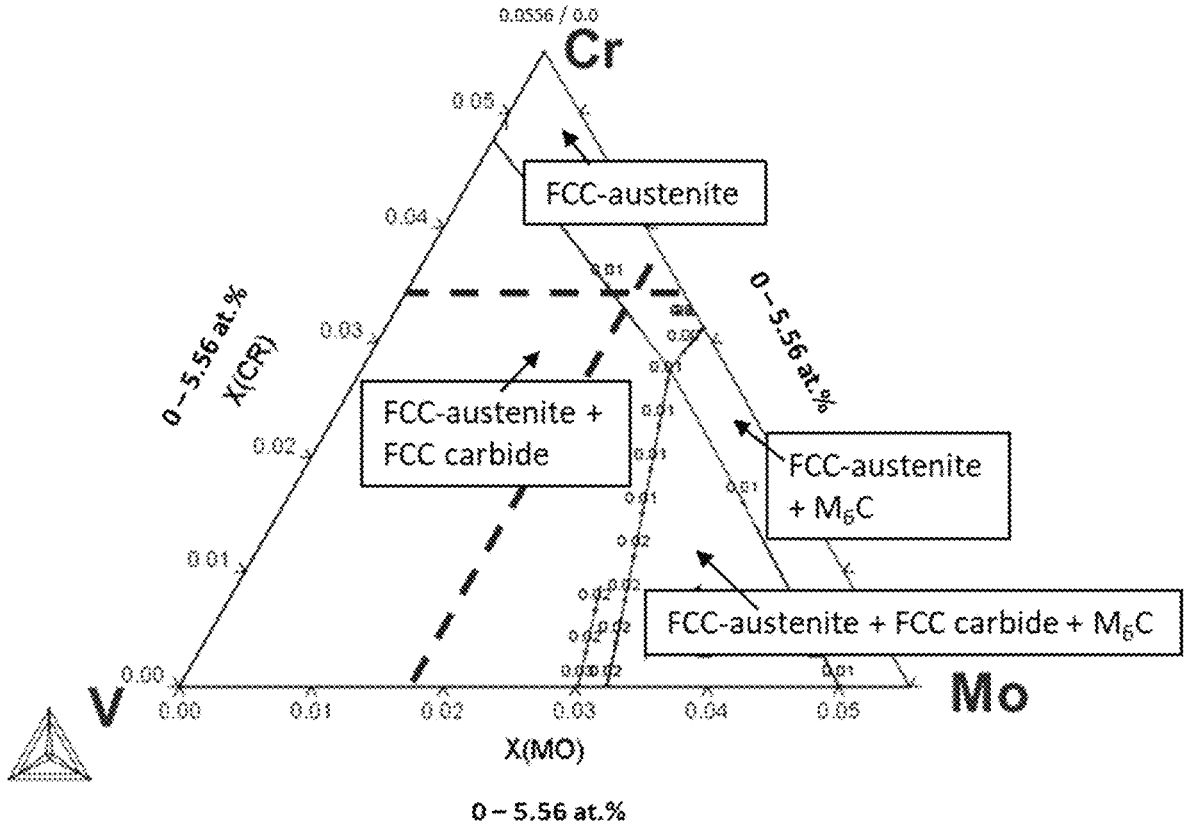
FIG. 2 shows an isothermal section of the pseudo-ternary phase diagram for alloy composition Fe-1 wt. %Cu-1 wt. %Ni-0.3 wt. %Mn-0.6 wt. %C-xCr-yMo-zV identifying phase regions as function of atomic fraction carbide formers for a fixed carbide ratio (x+y+z=2*at %C=5.56 at %, where x, y and z are in atomic %) at 1100° C. Calculations were performed using Thermo-Calc software and QuesTek developed thermodynamic database.

FIG. 2 shows the thermodynamic modeling output used to identify the composition boundaries in which single phase FCC austenite is stable at the solution carburizing temperature of 1100° C. The single-phase composition window typically increases with increasing temperature. It can be seen in FIG. 2 that the desired phase region for this example chemistry at the maximum solution carburizing temperature of 1100° C. is in the upper right (Cr-rich) corner. In the plot, the thinner lines represent the phase boundaries, and the thick dotted lines identify an example alloy composition of interest. The single-phase FCC composition window narrows down the range of alloy composition desirable for optimal performance.

Figure 3:
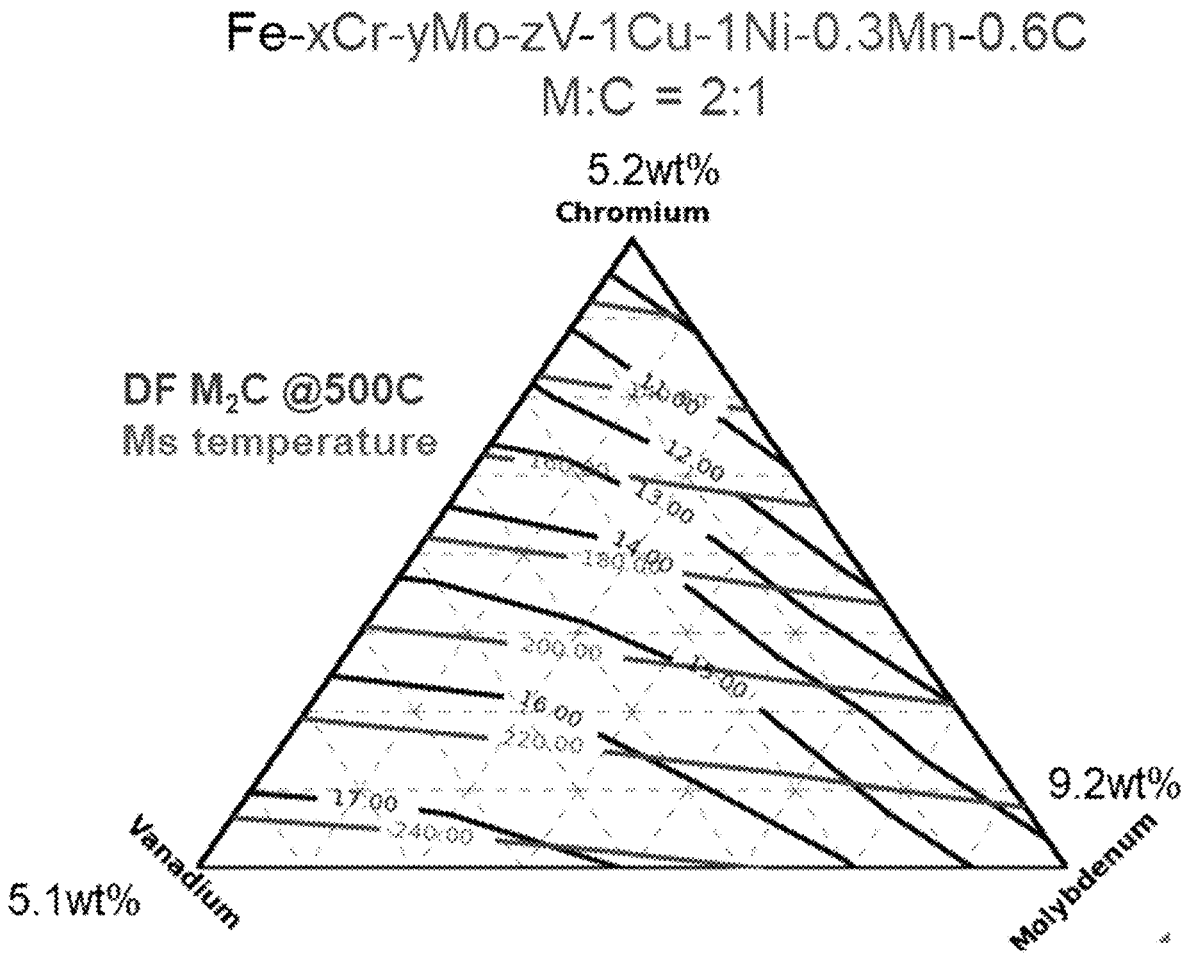
FIG. 3 is a representative modeling output, showing the trade-off between design parameters (thermodynamic driving force (DF) for $M_2C$ in kJ/mol, and case Ms temperature in ° C.) for a fixed $M_2C$ volume fraction as a function of alloy chemistry in Fe-1Cu-1Ni-0.3Mn-0.6C-xCr-yMo-zV (wt. %) at a fixed M:C atomic ratio equals 2:1.

In addition to ensuring single-phase FCC at the carburizing temperature, the amount of martensite formed upon quenching and precipitation of strengthening $M_2C$ precipitates can impact achieving strength targets. A ternary property plot (shown in FIG. 3) maps the effect of precipitation strengthening alloying elements (Cr, V, Mo) on the key property objectives (Ms temperature, $M_2C$ driving force) for fixed composition of other elements, carbon content and $M_2C$ volume fraction, i.e., M:C atomic ratio. The $M_2C$ driving force and the Ms temperature are calculated at the case carbon level in the ternary Cr—Mo—V space. A limiting factor in this mechanical property-optimized chemistry space is to ensure fully austenite microstructure upon solution annealing at a maximum temperature of 1100° C. along with sufficiently high Ms temperature and adequate driving force for $M_2C$ carbide precipitation.

The composition space that meets driving force, Ms and single-phase FCC requirements is in the Cr-rich corner of the ternary plot. In that FCC-austenite single-phase composition region, the $M_2C$ precipitate driving force is close to that required to achieve the set case hardness target and the Ms temperature is above the required case Ms temperature limit. A set of different alloy compositions within this compositional space were determined that fulfilled one or more of the design requirements but were at different performance and cost levels. These are outlined (2A-2F alloys) along with other designed alloy compositions in Table 2 (further below).

B. Exemplary Alloy Components and Properties

Example steel alloys can include chromium, molybdenum, vanadium, copper, nickel, manganese, niobium, aluminum, and iron. After exemplary alloys are subjected to carburizing and/or nitriding (e.g., plasma nitriding), the alloys can additionally include carbon and/or nitrogen. In some instances, the alloy can include MX carbide precipitates that can act as grain pinning particles. Typically, example steel alloys do not include cobalt. In some instances, example steel alloys include less than 0.001 wt % Co.

In some instances, example alloys can include, by weight percentage, 3.0% to 8.0% chromium; 0.02% to 5.0% molybdenum; 0.1% to 1.0% vanadium; 0.5% to 2.5% copper; 0.5% to 2.0% nickel; 0.2% to 0.4% manganese; 0.01% to 0.05% niobium; 0.1% to 1.0% aluminum, and the balance iron and incidental elements and impurities.

In some instances, example alloys can include, by weight percentage, 3.5% to 5.5% chromium; 0.05% to 2.5% molybdenum; 0.2% to 0.5% vanadium; 1.0% to 2.0% copper; 0.8% to 1.5% nickel; 0.2% to 0.4% manganese; 0.01% to 0.05% niobium; 0.3% to 0.8% aluminum; no more than about 1.0% nitrogen, and the balance iron and incidental elements and impurities.

In some instances, example alloys can include, by weight percentage, 3.2% to 4.9% chromium; 0.08% to 3.3% molybdenum; 0.24% to 0.4% vanadium; 1% to 1.6% copper; 0.8% to 1% nickel; 0.2% to 0.4% manganese; 0.01% to 0.05% niobium; 0.6% to 0.8% aluminum; no more than about 1.0% nitrogen, and the balance iron and incidental elements and impurities.

Example alloys can include, by weight percentage, 3.0% to 8.0% chromium. For instance, exemplary alloys can include, by weight percentage, 3.0% to 7.0% chromium; 3.0% to 6.0% chromium; 3.0% to 5.0% chromium; 4.0% to 8.0% chromium; 4.0% to 7.0% chromium; 4.0% to 6.0% chromium; 3.5% to 5.5% chromium; 4.5% to 6.5% chromium; 3.2% to 4.9% chromium; or 5.0% to 7.0% chromium.

Example alloys can include, by weight percentage, 0.02% to 5.0% molybdenum. For instance, exemplary alloys can include, by weight percentage, 0.02% to 4.0% molybdenum; 0.02% to 3.0% molybdenum; 0.02% to 2.0% molybdenum; 0.02% to 1.0% molybdenum; 0.05% to 2.5% molybdenum; 0.05% to 3.5% molybdenum; 0.08% to 3.3% molybdenum; 0.1% to 3.0% molybdenum; 0.5% to 3.5% molybdenum; 1.0% to 4% molybdenum; 2.0% to 4% molybdenum; or 1.5% to 3.5% molybdenum.

Example alloys can include, by weight percentage, 0.1% to 1.0% vanadium. For instance, exemplary alloys can include, by weight percentage, 0.1% to 0.75% vanadium; 0.2% to 0.8% vanadium; 0.2% to 0.5% vanadium; 0.24% to 0.4% vanadium; 0.4% to 0.9% vanadium; 0.5% to 1.0% vanadium; 0.3% to 0.6% vanadium; or 0.6% to 0.8% vanadium.

Example alloys can include, by weight percentage, 0.5% to 2.5% copper. For instance, exemplary alloys can include, by weight percentage, 0.5% to 2.0% copper; 1.0% to 2.0% copper; 1.5% to 2.5% copper; 1.0% to 1.6% copper; 0.75% to 2.25% copper; or 1.0% to 2.5% copper.

Example alloys can include by weight percentage, 0.5% to 2.0% nickel. For instance, exemplary alloys can include, by weight percentage, 0.5% to 1.5% nickel; 0.8% to 1.5% nickel; 0.8% to 1.0% nickel; 1.0% to 2.0% nickel; 0.75% to 2.0% nickel; or 1.5% to 2.0% nickel. In some instances, example alloys can have a ratio of nickel (Ni) to copper (Cu) of at least about 0.5; 0.5-1.0; 0.5-0.75; about 0.5; or 0.5.

Example alloys can include, by weight percentage, 0.2% to 0.4% manganese. For instance, exemplary alloys can include, by weight percentage, 0.2% to 0.3% manganese; 0.25% to 0.4% manganese; 0.3% to 0.4% manganese; or 0.25% to 0.35% manganese.

Example alloys can include, by weight percentage, 0.01% to 0.05% niobium. For instance, exemplary alloys can include, by weight percentage, 0.01% to 0.03% niobium; 0.03% to 0.05% niobium; 0.02% to 0.04% niobium; 0.015% to 0.035% niobium; 0.01% to 0.04% niobium; 0.02% to 0.05% niobium; or 0.03% to 0.05% niobium.

Example alloys can include, by weight percentage, 0.1% to 1.0% aluminum. For instance, exemplary alloys can include, by weight percentage, 0.1% to 0.75% aluminum; 0.2% to 0.8% aluminum; 0.2% to 0.5% aluminum; 0.24% to 0.4% aluminum; 0.4% to 0.9% aluminum; 0.5% to 1.0% aluminum; 0.3% to 0.6% aluminum; 0.3% to 0.8% aluminum; 0.7% to 1.0% aluminum; 0.6% to 0.8% aluminum. In some instances, example alloys subjected to carburizing but not plasma nitriding may have less than 0.1 wt % aluminum or less than 0.01 wt % aluminum.

Incidental elements and impurities in the disclosed steel alloys may include, but are not limited to, silicon, oxygen, phosphorous, sulfur, tin, antimony, arsenic, and lead. In some instances, incidental elements and impurities can adhere to raw material stock. Incidental elements and impurities may be present in the alloys disclosed herein in amounts totaling no more than 0.5 wt %, no more than 0.4 wt %, no more than 0.3 wt %, no more than 0.2 wt %, no more than 0.1 wt %, no more than 0.05 wt %, no more than 0.01 wt %, or no more than 0.001 wt %. In some instances, incidental elements and impurities may be present in the alloys in the following amounts: no more than 0.05 wt % phosphorus, no more than 0.03 wt % sulfur, no more than 0.075 wt % tin, no more than 0.075 wt % antimony, no more than 0.075 wt % arsenic, and no more than 0.01 wt % lead.

After solution carburizing at 1000° C.-1100° C. for 1 hour to 8 hours and aging at 450° C. to 550° C. for 2 hours to 48 hours, the alloy can include a case portion and a core portion. In some instances, the alloy has a case hardness of greater than 700 HV; greater than 750 HV; or greater than 800 HV. In some instances, the case portion includes 0.6-0.8 wt % carbon. In some instances, a case depth of an alloy is greater than 2 mm. In some instances, the alloy has a core hardness of greater than 360 HV; greater than 400 HV; greater than 450 HV; or greater than 500 HV. Typically, the alloy has a microstructure including a martensitic matrix including copper nanoprecipitates and nanoscale $M_2C$ carbides. In some instances, the case portion has a case hardness of greater than 700 HV. In some instances, the core portion includes 0.1-0.2 wt % carbon.

After solution carburizing at 1050° C.-1100° C. for 1 hour to 8 hours and plasma nitriding at a temperature of 450° C. to 550° C. for 2 hours to 48 hours, as discussed below, the alloy can include a case portion and a core portion. In some instances, the case portion includes a case microstructure including a fully-lath martensite matrix with strengthening precipitates including AlN, $Cr_2N$, $M_2(C,N)$ and body centered cubic copper phases. In some instances, the case portion includes 0.3-0.6 wt % carbon and 0.1-1.0 wt % nitrogen and has a case hardness of greater than 900 HV; greater than 950 HV; or greater than 1000 HV. In some instances, a case depth of a carburized alloy is greater than 2 mm. In some instances, a case depth of a nitrided alloy is greater than 0.2 mm. In some instances, the core portion has a core microstructure including a fully-lath martensite matrix with strengthening precipitates including $M_2C$ and body centered cubic copper phases. In some instances, the core portion has a hardness of greater than 360 HV; greater than 400 HV; greater than 450 HV; or greater than 500 HV.

III. PLASMA NITRIDING OR CARBONITRIDING DURING AGING

In addition to carburizing, plasma nitriding during aging treatment can also be utilized for further improvement of the surface properties. The operating temperature and time for plasma-nitriding can also automatically ensure aging of the carburized alloy to enable carbide precipitation. Alloy composition designs were optimized for precipitation of nitride phases (chromium and aluminum nitrides) to improve the surface hardness during nitriding of these $M_2C$-strengthened carburized gear steels.

Initial design calculations were performed by decreasing the case carbon content to 0.4 wt. % to allow more M (e.g., Cr, Mo, V) available for nitride formation. The ratio of M:C was increased to 3:1 for the modeling calculations to ensure similar amount of alloying additions compared to 0.6 wt % C with M:C ratio of 2:1. The case C level was selected as the predicted total case hardness (including Cr-rich $M_2C/M_2(C,N)$ precipitation) would be closer to the target case hardness value. 0.4 wt. % C was identified to provide a good balance for subsequent nitriding; decreasing the case C below 0.4 wt % would likely result in the carburized layer below the nitride layer to have low hardness, while increasing the case C higher than 0.4% would result in insufficient hardness contribution from nitride/carbonitride precipitation. For just carburization, an upper limit of 0.6 wt % C to 0.8 wt % C in the case layer.

Figure 4A:
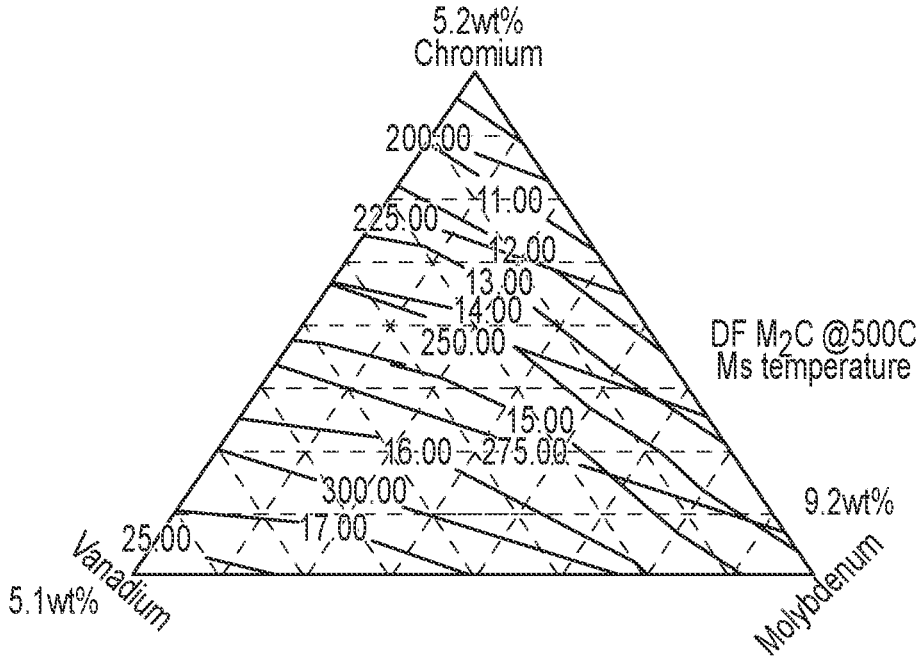
FIG. 4A is a ternary property diagram showing variation in $M_2C$ driving force at 500° C. and Ms temperature (in ° C.) as function of chemistry for Fe-1Cu-1Ni-0.3Mn-0.4C-xCr-yMo-zV. M:C atomic ratio is 3:1.
Figure 4B:
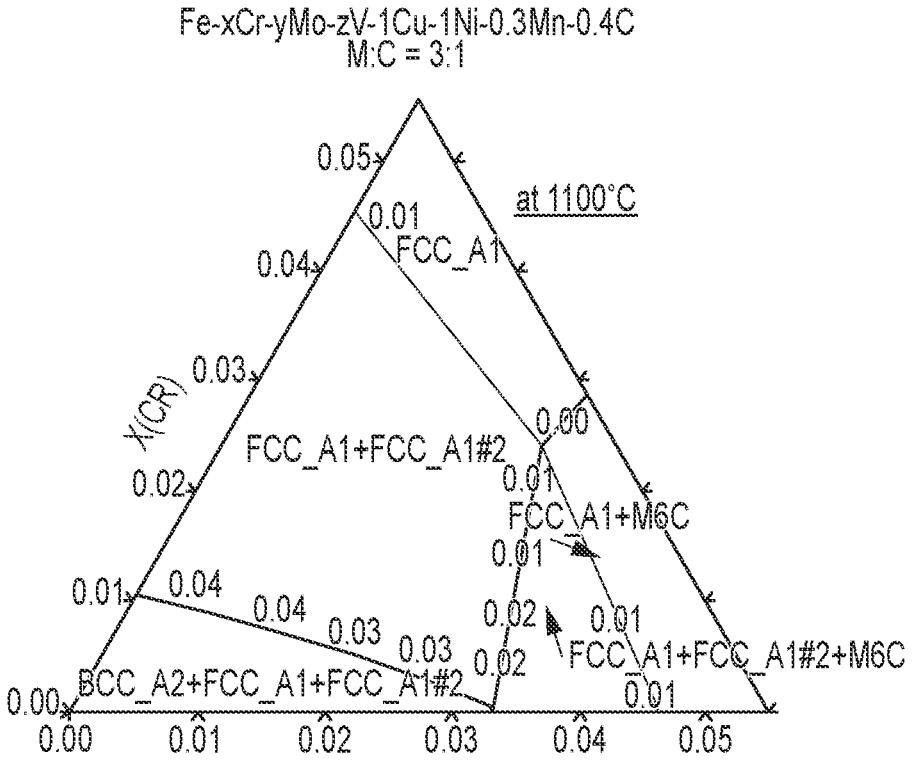
FIG. 4B is the pseudo-ternary phase diagram at 1100° C. with same composition variation as in FIG. 4A.

Calculated property predictions for the lower case C level is shown in FIG. 4A and FIG. 4B. The results suggest no significant change in the $M_2C$ driving force and an increase in the case Ms temperature after carburization compared to the same base alloy composition with a carburization level of 0.6 C. The workable solution temperature window is larger for the lower C content as shown in FIG. 4B. This would make it easier to ensure single phase FCC at the solution carburizing temperature.

Figure 5:
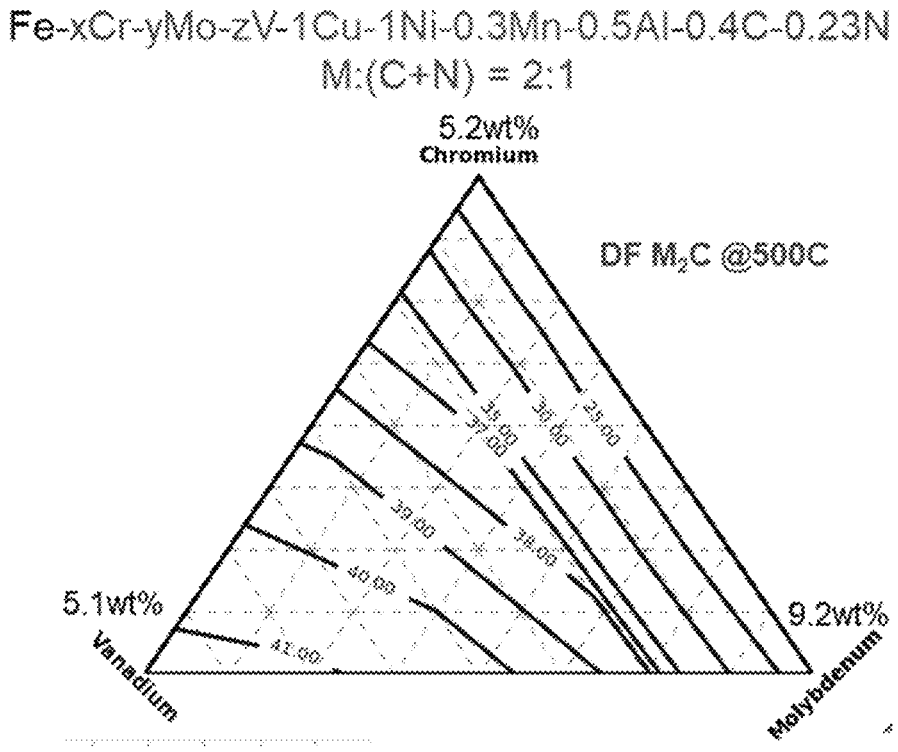
FIG. 5 is a ternary property diagram showing driving force variation of $M_2(C,N)$ at 500° C. from supersaturated BCC solid solution in a Fe-1Cu-1Ni-0.3Mn-0.4C-0.23N-xMo-yCr-zV alloy with a M:(C+N) ratio of 2:1.

For a design with reduced C content and increased available $M_2C$-forming elements ('M'=Cr,V,Mo), the addition of N in the calculations (for stoichiometric ratio M:(C+N) of 2:1) results in increased driving force for $M_2(C,N)$ as shown in FIG. 5. These calculations are performed assuming precipitation of $M_2(C,N)$ from a supersaturated BCC matrix without taking into account any para-equilibrium precipitates. The calculations suggest an increase in the driving force and also the phase fraction of strengthening $M_2(C,N)$ precipitates, which should result in higher case hardness.

In comparison to driving force for $M_2C$ precipitation in fully carburized condition, the driving force for $M_2(C,N)$ precipitates in carburized+nitrided condition is seen to be equally dependent on Cr and Mo addition. Therefore, reducing case C to 0.4 wt. % is predicted to free up sufficient Cr for hardness improvement via nitriding to achieve overall target hardness of the case layer while maintaining sufficient minimum hardness of the underlying carburized-only case layer.

IV. EXEMPLARY METHODS OF MANUFACTURE

Example steel alloys disclosed and contemplated herein can be formed by various exemplary methods. An example method may include one or more of: preparing a melt, casting followed by forging, solution carburizing, quenching, and then plasma nitriding or aging the alloy. In some instances, carburizing, until about 0.6 wt % to about 0.78 wt % carbon content in the case portion, may be combined with aging. In some instances, carburizing, until about 0.45 wt % to about 0.55 wt % carbon content in the case portion, may be combined with plasma nitriding.

For example, an example method of making an alloy can include preparing a melt that includes, by weight, 3.0% to 8.0% chromium; 0.02% to 5.0% molybdenum; 0.1% to 1.0% vanadium; 0.5% to 2.5% copper; 0.5% to 2% nickel; 0.2% to 0.4% manganese; 0.01% to 0.05% niobium; 0.1% to 1.0% aluminum, and the balance iron and incidental elements and impurities. Other combinations of elements, such as exemplary amounts discussed above, are contemplated. In some instances, the melt is homogenized. Homogenization temperatures and times may be selected based on components in the alloy. For instance, homogenization may be performed at about 1230° C. for about 16 hours.

Next, the melt may be subjected to solution carburizing. In some instances, roll reduction and/or flattening may be performed after preparing the melt but before solution carburizing.

Solution carburizing may be performed at a temperature of about 1000° C. to about 1150° C. In various implementations, solution carburizing may be performed at a temperature of 1000° C. to 1150° C.; 1025° C. to 1150° C.; 1050° C. to 1150° C.; 1000° C. to 1100° C.; 1025° C. to 1125° C.; 1050° C. to 1100° C.; or 1025° C. to 1075° C. In various implementations, solution carburizing may be performed for 1 hour to 8 hours; 2 hours to 8 hours; 4 hours to 8 hours; 1 hour to 3 hours; 3 hours to 5 hours; 5 hours to 7 hours; or 6 hours to 8 hours.

Solution carburizing may be followed by quenching. After quenching, the method may include either plasma nitriding or aging the alloy. Plasma nitriding is a low temperature process carried out in a vacuum vessel where a high-voltage electrical charge forms plasma, causing nitrogen ions to accelerate and impinge on the metal. An exemplary gas mixture used during plasma nitriding comprises nitrogen ($N_2$) and hydrogen ($H_2$) in the ratio of 20% to 80%.

In various implementations, plasma nitriding may be performed at 450° C. to 550° C.; 475° C. to 525° C.; 450° C. to 500° C.; 500° C. to 550° C.; 475° C. to 500° C.; 500° C. to 525° C.; 525° C. to 550° C.; or 515° C. to 525° C. In various implementations, plasma nitriding may be performed for 2 hours to 36 hours; 8 hours to 36 hours; 12 hours to 36 hours; 16 hours to 36 hours; 20 hours to 36 hours; or 22 hours to 36 hours.

In various implementations, aging may be performed at 450° C. to 550° C.; 475° C. to 525° C.; 450° C. to 500° C.; 500° C. to 550° C.; 475° C. to 500° C.; 500° C. to 525° C.; 525° C. to 550° C.; 475° C. to 485° C.; or 515° C. to 525° C. In various implementations, aging may be performed for 2 hours to 16 hours; 4 hours to 16 hours; 8 hours to 16 hours; 12 hours to 16 hours; 2 hours to 4 hours; 4 hours to 8 hours; about 2 hours; about 4 hours; about 8 hours; or about 16 hours.

V. EXAMPLE APPLICATIONS

Example alloys disclosed and contemplated herein can be used in various implementations. In some instances, example alloys are used in articles of manufacture utilized in applications requiring high case hardness and/or high core hardness along with improved core toughness. example manufactured articles include, but are not limited to, gears and shafts.

VI. EXEMPLARY ALLOY COMPOSITIONS

Various exemplary alloy compositions were computationally, and experimentally evaluated, and selected attributes are discussed below.

A. Calculated Parameters of Example Alloy Compositions

Based on one or more design parameters discussed above, a set of alloy compositions along with carburization, nitriding levels and solution carburizing temperature were designed. Table 2 below shows the different compositions proposed for case-hardened steels, and Table 3 shows calculated design parameters for the alloys shown in Table 2.

TABLE 2

Example steel alloy compositions where components are in weight percent (wt %).

| Name | Cr | Mo | V | Cu | Ni | Mn | Nb | Al | Core N | Case N | Core C | Case C |
|---|---|---|---|---|---|---|---|---|---|---|---|---|
| 2A | 2.62 | 4 | 0.4 | 1 | 0.5 | 0.3 | 0.01 | — | 0.01 | — | 0.1 | 0.6 |
| 2B | 4.64 | 0.08 | 0.6 | 1 | 0.5 | 0.3 | 0.01 | — | 0.01 | — | 0.1 | 0.6 |
| 2C | 3.2 | 3.3 | 0.24 | 1 | 0.5 | 0.3 | 0.01 | — | 0.01 | — | 0.1 | 0.6 |
| 2D | 4.9 | 0.08 | 0.39 | 1 | 0.5 | 0.3 | 0.01 | — | 0.01 | — | 0.1 | 0.6 |
| 2E | 2.62 | 4 | 0.4 | 1 | 1 | 0.3 | 0.01 | — | 0.01 | — | 0.1 | 0.6 |
| 2F | 3.2 | 3.3 | 0.24 | 1 | 1 | 0.3 | 0.01 | — | 0.01 | — | 0.1 | 0.6 |
| 2G | 4.8 | 1.1 | 1.2 | 0.5 | 0.5 | 0.3 | 0.01 | — | 0.01 | — | 0.1 | 0.75 |
| 2G1 | 4.8 | 1.1 | 1.2 | 1 | 0.5 | 0.3 | 0.01 | — | 0.01 | — | 0.1 | 0.75 |
| 2H | 4.9 | 0.08 | 0.4 | 1.6 | 0.8 | 0.3 | 0.05 | 0.8 | 0.01 | — | 0.15 | 0.6 |
| 2H-1 | 4.9 | 0.08 | 0.4 | 1.6 | 0.8 | 0.3 | 0.05 | 0.8 | 0.01 | — | 0.15 | 0.4 |
| 2H-N | 4.9 | 0.08 | 0.4 | 1.6 | 0.8 | 0.3 | 0.05 | 0.8 | 0.01 | 0.65 | 0.15 | 0.4 |

TABLE 3

Calculated properties for alloys in Table 2.

| Name | $T_s$,° C. | Case $M_s$ | $M_2X$ DF (kJ) (Calc. at 482° C.) | Fraction $M_2X$ (calculated) |
|---|---|---|---|---|
| 2A | 1100 | 184 | 13.3 | 0.05 |
| 2B | 1100 | 157 | 10.8 | |
| 2C | 1050 | 176 | 12.2 | |
| 2D | 1050 | 154 | 10.3 | |
| 2E | 1100 | 171 | 13.4 | |
| 2F | 1050 | 164 | 12.3 | |
| 2G | 1200 | 118 | 13.3 | 0.1 |
| 2G1 | 1200 | 101 | 13.4 | 0.1 |
| 2H | 1050 | 154 | 10.75 | 0.08 |
| 2H-1 | 1050 | 225 | 10.75 | 0.055 |
| 2H-N | 1050 | 225 | >11 | >0.08 +Cr2N, AlN |

As shown, the exemplary alloys include 0.3 wt. % Mn, which may getter typical sulfur impurities in the air melting casting process. For the generated alloys in Table 2, 0.01-0.05 wt. % Nb and about 0.01 wt. % N have been added to the core composition in order to form Nb(C,N), which may serve as grain refining precipitates.

Figure 6A:
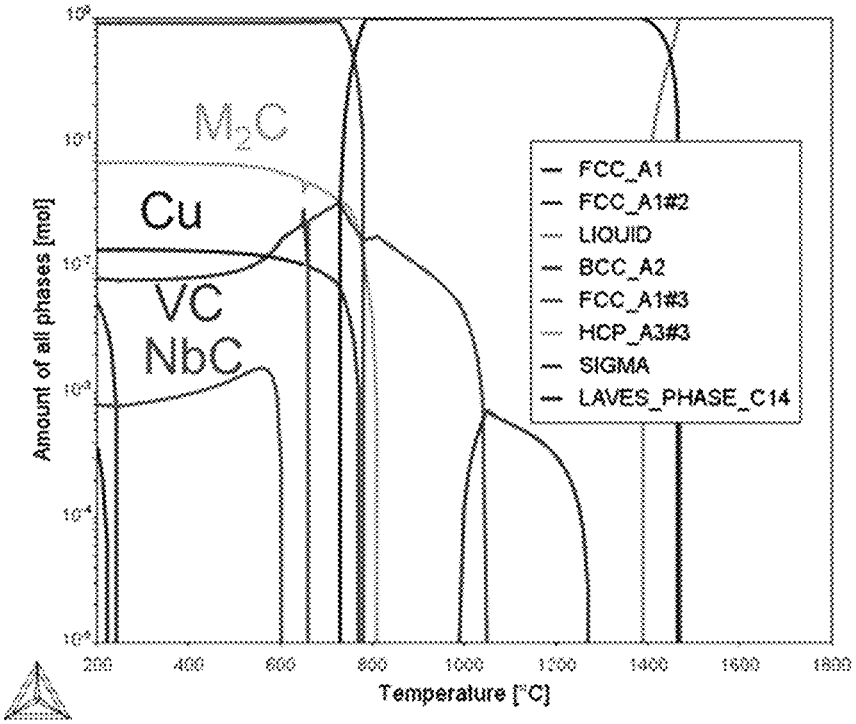
FIG. 6A shows thermodynamic calculations showing the equilibrium phases as a function of temperature for designed Alloy 2H with 0.6 wt. % carbon in the case portion.
Figure 6B:
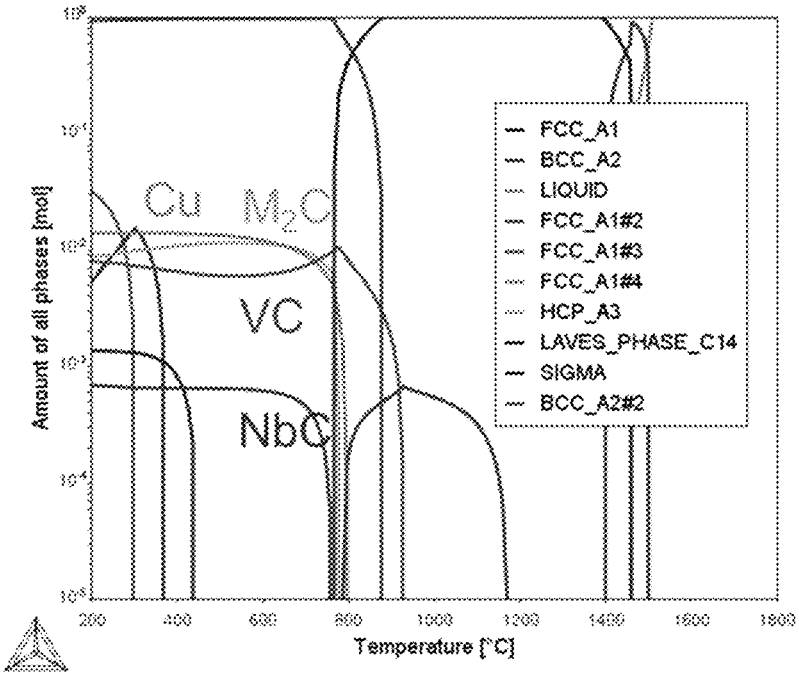
FIG. 6B shows thermodynamic calculations showing the equilibrium phases as a function of temperature for Alloy 2H with 0.15 wt. % carbon in the core portion.
Figure 6C:
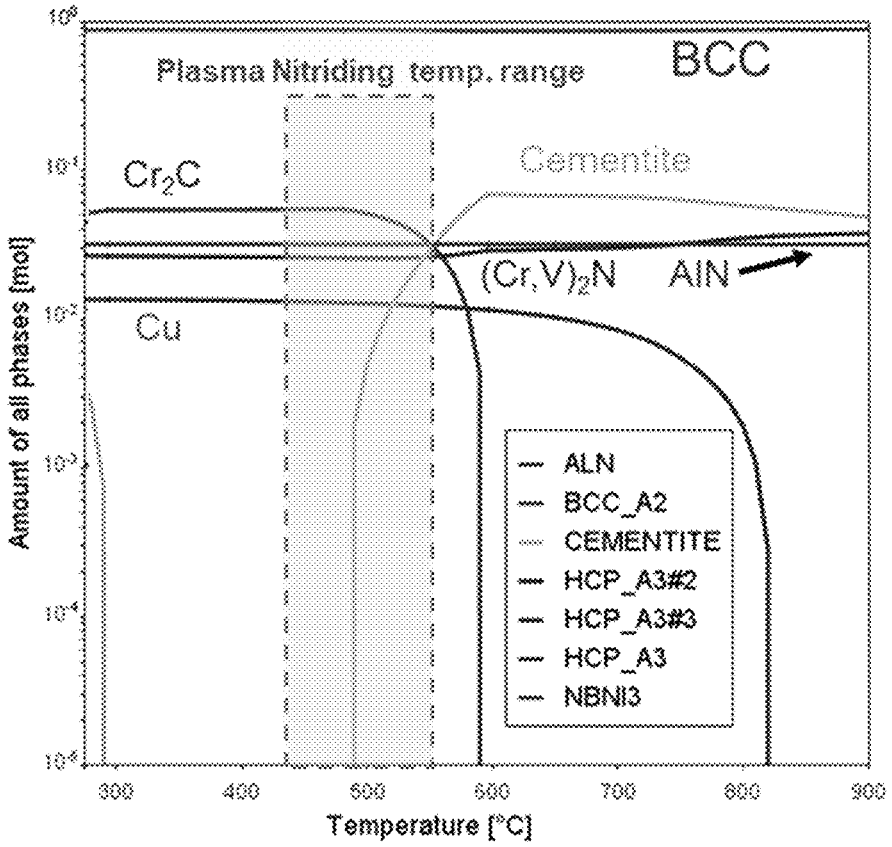
FIG. 6C shows thermodynamic calculations showing the equilibrium phases as a function of temperature for designed Alloy 2H with 0.4 wt % C and 0.65 wt % N in the case region representing conditions after carburization followed by plasma nitriding.

Equilibrium calculations for Alloy 2H as a function of temperature for the 0.6 wt. % case C and 0.15 wt. % core C levels are shown in FIG. 6A and FIG. 6B. The results show adequate high temperature stability of grain pinning particles (Nb,V)C close to solution carburizing temperatures. In the aging temperature range of 450° C.-550° C., the $M_2C$ carbides are seen to be stable along with Cu phase. Equilibrium calculations for Alloy 2H as a function of temperature for the 0.4 wt. % case C and 0.65 wt % case N is shown in FIG. 6C. The results predict precipitation of strengthening AlN, Cu, $M_2C$, and $M_2N$ precipitates at temperatures within the range of plasma nitriding treatment.

B. Exemplary Experimental Alloys

Various exemplary experimental alloys were prototyped. The experimental alloys were processed according to the time-temperature schematic in FIG. 7, which included the following processing operations: (1) homogenization, (2) roll reduction, (3) flattening, (4) solution carburizing, (5) quenching, and (6) either aging (a) or plasma nitriding (b). The different processing steps are outlined along with exemplary temperatures and times for each step.

The experimentally studied alloy was homogenized to remove compositional segregation, then hot rolled to refine the grain structure by initiating recrystallization of grains. This was followed by solution carburization and quenching to produce the carbon rich case layer with a martensitic matrix microstructure for case hardening. The carburized samples were then either tempered to result in case hardening or subjected to plasma ion nitriding for further improvement in case hardness.

Table 4 below provides the designed and measured compositions for an experimental alloy.

TABLE 4

Designed versus measured composition of prototyped alloy in weight %.

| Element | Design | Actual |
|---|---|---|
| C | 0.15 | 0.20 |
| Cr | 4.9 | 4.84 |
| Mo | 0.08 | 0.11 |
| V | 0.4 | 0.37 |
| Cu | 1.6 | 1.51 |
| Ni | 0.8 | 0.83 |
| Mn | 0.3 | 0.29 |
| Nb | 0.05 | 0.06 |
| Al | 0.8 | 0.9 |
| Si | 0.3 | 0.34 |
| O | 0.006 | — |
| S | 0.003 | — |
| N | 0.008 | 0.002 |
| Ca | 0.008 | 0.003 |

The prototyped alloy was subjected to two different carburization cycles, namely, 2H-B1 (full carburization) and 2H-B2 (partial carburization). The two cycles targeted two different levels of case carbon.

The hardness measured across the cross sectional of the carburized samples along with the measured carbon content at different depths is shown in FIG. 8. Three separate measurements at each depth were carried out using Vickers Hardness indents with a load of 0.5 kgf and 10 s dwell time. Carbon content was measured with Optical Emission Spectroscopy (OES) at various case depths. FIG. 8 shows case hardness close to ~800HV in the 2H-B1 as-carburized condition. Both carburization cycles show case depth of higher than 2 mm.

The 2H prototyped alloy carburized with the B1 carburization cycle was aged at two different aging temperatures to precipitate strengthening $M_2C$ carbide phases. The precipitation of these phases can improve the case hardness and can provide temper stability to the case hardness profile. The as-carburized condition is seen to have highest hardness due to the quenched microstructure and associated stresses but can be quite unstable when exposed to higher temperatures.

Tempering at 480° C. shows an overall increase in hardness in the case and core regions going from 2 hours to 24 hours, as shown in in FIG. 9. Tempering at 520° C. also shows similar hardening response due to precipitation of strengthening precipitates as shown in FIG. 10. Although the kinetics of precipitation are faster at 520° C., it appears that temperature can lead to over aging with longer aging times.

FIG. 10 shows micrographs of the microstructure of the alloy in the case region close to surface, in the transition region (~1 mm from surface), and in the core (>2.5 mm from surface). The microstructures shown are for samples that carburized with CC-B1 cycle and subsequently aged at 480° C. and 520° C. for 16 hours. The images show martensitic microstructure in all the regions with some amount of retained austenite in regions close to surface.

The 2H alloy was also subjected to the CC-B2 carburization cycle that aimed at lower case carbon levels. FIG. 12 shows the hardness profile in the as-carburized condition and that after being aged at 520° C. for different times. The results show good temper stability of the case hardness profile and evidence of precipitation strengthening throughout the microstructure. The microstructure of the case region close to surface, in the transition region (~1 mm from surface), and in the core (>2.5 mm from surface) after aging at 520° C. for 16 hours is shown in FIG. 13.

The 2H-CC-B2 (low carburized) samples were subjected to plasma ion nitriding (PIN) using a gas mixture of 20% $N_2$ and 80% $H_2$ at 520 C for 24 hrs. The PIN process was done to provide additional surface hardening up to a shallow depth (~0.2 mm) on top of the carburized layer which has a much deeper case depth (>2 mm). The tempering of carburized microstructure to precipitate strengthening carbides would happen during the PIN processing at 520° C. Cross sectional hardness measurements for the carburized+nitrided sample is shown in FIG. 14. The three hardness regions i.e. carburized+nitrided, only carburized and core region are marked in the figure. The microstructure across the cross section of the sample is shown in FIG. 15. The diffusion zone is the region affected by nitrogen diffusing into the alloy during the PIN process.

C. Atom Probe Tomography

Local electrode atom probe (LEAP) studies were utilized to reconstruct the atomic distribution of elements in the carburized case region of 2H-CC-B2 samples. The average carbon (C) content in the reconstructed region was 0.37 wt % which is higher than core 0.2 wt % but lower than case level of ~0.6 wt %. The sample was aged at 520° C. for 16 hours to ensure precipitation of strengthening carbides and copper precipitates. The ion reconstruction with the interfaces outlined for $M_2C$ carbides (7.5 wt % C iso-concentration surfaces) and copper precipitates (4.5 wt % Cu iso-concentration surfaces) is shown in FIG. 16.

The precipitation of $M_2C$ carbides at the interface of copper precipitates and matrix is indicated by the close proximity of Cu precipitates and $M_2C$ carbides as shown in FIG. 17. FIG. 17 shows a magnified portion of the three-dimensional atom probe tomography shown in FIG. 16, and, more specifically, an image of one of the carbides surrounded by multiple copper particles. The copper particles can be seen to connect to the adjacent $M_2C$ carbide at the center of the image.

The composition of the carbides is measured via a proximity histogram shown in FIG. 18 that measures the average variation of composition across the carbide/matrix interface. The carbide can be seen to be rich in carbon and chromium which is the main $M_2C$ forming element. The ratio of Cr/C is approximately 2:1 which is clear evidence for $M_2C$ carbide precipitation. The plot in FIG. 18 also shows presence of a copper enriched region close to the matrix/carbide interface, which is likely attributable to a presence of copper particles. These results provide evidence to validate that the designed alloy microstructure includes fine nanoscale $M_2C$ carbides that are formed in close proximity to the matrix/Cu interface. The presence of Fe inside the carbides and Copper particles can be attributed to the local magnification effect of the major constituent element in small particles reconstructed in LEAP studies.

For the recitation of numeric ranges herein, each intervening number there between with the same degree of precision is contemplated. For example, for the range of 6-9, the numbers 7 and 8 are contemplated in addition to 6 and 9, and for the range 6.0-7.0, the numbers 6.0, 6.1, 6.2, 6.3, 6.4, 6.5, 6.6, 6.7, 6.8, 6.9, and 7.0 are contemplated. For another example, when a pressure range is described as being between ambient pressure and another pressure, a pressure that is ambient pressure is expressly contemplated.

It is understood that the foregoing detailed description and accompanying examples are merely illustrative and are not to be taken as limitations upon the scope of the disclosure. Various changes and modifications to the disclosed embodiments will be apparent to those skilled in the art. Such changes and modifications, including without limitation those relating to the chemical structures, substituents, derivatives, intermediates, syntheses, compositions, formulations, or methods of use, may be made without departing from the spirit and scope of the disclosure.

What is claimed is:

1. An alloy comprising, by weight percentage:
3.2% to 8.0% chromium;
0.02% to 3.0% molybdenum;
0.4% to 1.0% vanadium;
1.5% to 2.5% copper;
0.5% to 2% nickel;
0.2% to 0.4% manganese;
0.01% to 0.05% niobium;
0.1% to 1.0% aluminum;
less than 0.01% silicon;
less than 0.01% sulfur; and
the balance iron and incidental elements and impurities,
wherein the alloy has been solution carburized at 1000° C. to 1100° C. for 1 hour to 8 hours and wherein the alloy includes a case portion and a core portion;
wherein the case portion includes 0.3-0.5 wt % carbon or 0.6-0.8 wt % carbon;
wherein the core portion includes 0.1-0.2 wt % carbon; and
wherein an alloy microstructure is primarily martensitic.

2. The alloy according to claim 1, wherein the alloy has been solution carburized at 1000° C. to 1100° C. for 1 hour to 8 hours and tempered at 450° C. to 550° C., and the alloy includes a case portion and a core portion,
wherein the alloy has a core hardness of greater than 360 HV and the alloy microstructure comprises copper nanoprecipitates and nanoscale $M_2C$ carbides.

3. The alloy according to claim 1, wherein the alloy has been solution carburized at 1000° C. to 1100° C. for 1 hour to 8 hours and tempered at 450° C. to 550° C., and the alloy includes a case portion and a core portion,
wherein the case portion includes 0.6-0.8 wt % carbon;
wherein the case portion has a case hardness of greater than 700 HV;
wherein the core portion has a core hardness of greater than 360 HV; and
wherein the core portion includes 0.1-0.2 wt % carbon.

4. The alloy according to claim 1, wherein the alloy has been solution carburized at 1000° C. to 1100° C. for 1 hour to 8 hours and has been subjected to plasma nitriding at a temperature of 450° C. to 550° C., and the alloy includes a case portion and a core portion; and
wherein the case portion includes 0.3-0.5 wt % carbon and 0.4-1.0 wt % nitrogen, and has a case hardness of greater than 1000 HV.

5. The alloy according to claim 1, wherein the alloy has been solution carburized at 1000° C. to 1100° C. for 1 hour to 8 hours and plasma nitrided at a temperature of 450° C. to 550° C., and the alloy includes a case portion and a core portion;
wherein the case portion includes a case microstructure including a fully-lath martensite matrix with strengthening precipitates including AlN, $Cr_2N$, $M_2(C,N)$ and body centered cubic copper phases;
wherein the case portion has a hardness of greater than 1000 HV;
wherein the core portion has a core microstructure including a fully-lath martensite matrix with strengthening precipitates including $M_2C$ and body centered cubic copper phases; and
wherein the core portion has a hardness of greater than 360 HV.

6. The alloy according to claim 1, wherein the alloy comprises, by weight percentage:
3.5% to 5.5% chromium;
4.0% to 5.0% molybdenum;
0.4% to 0.8% vanadium;
1.5% to 2.0% copper;
0.8% to 1.5% nickel;
0.2% to 0.4% manganese;
0.01% to 0.05% niobium;
0.3% to 0.8% aluminum;
less than 0.01% silicon;
less than 0.01% sulfur; and
no more than about 1.0% nitrogen.

7. The alloy according to claim 6, wherein the alloy includes MX carbide precipitates that can act as grain pinning particles.

8. The alloy according to claim 7, wherein the alloy does not include cobalt; and
wherein a ratio of Ni to Cu is about 0.5.

9. A manufactured article comprising the alloy of claim 1.

10. The manufactured article according to claim 9, wherein the manufactured article is a gear or shaft.

11. A method for making an alloy, the method comprising:
preparing a melt, comprising, by weight percentage:
3.2% to 8.0% chromium;
0.02% to 3.0% molybdenum;
0.4% to 1.0% vanadium;
1.5% to 2.5% copper;
0.5% to 2% nickel;
0.2% to 0.4% manganese;
0.01% to 0.05% niobium;
0.1% to 1.0% aluminum;
less than 0.01% silicon;
less than 0.01% sulfur; and
the balance iron and incidental elements and impurities;
solution carburizing the melt at a temperature of 1000° C. to 1150° C. for 1 hour to 8 hours followed by quenching; and
after quenching, either plasma nitriding at 450° C. to 550° C. or tempering the alloy at 450° C. to 550° C.,
wherein the alloy includes a case portion and a core portion;
wherein the case portion includes 0.3-0.5 wt % carbon or 0.6-0.8 wt % carbon;
wherein the core portion includes 0.1-0.2 wt % carbon.

12. The method according to claim 11, wherein after solution carburizing at 1000° C. to 1100° C. for 1 hour to 8 hours and tempering at 450° C. to 550° C., the alloy includes a case portion and a core portion,
wherein the alloy has a core hardness of greater than 360 HV and the alloy microstructure comprises copper nanoprecipitates and nanoscale $M_2C$ carbides.

13. The method according to claim 11, wherein after solution carburizing at 1100° C. for 1 hour to 8 hours and tempering at 450° C. to 550° C., the case portion includes 0.6-0.8 wt % carbon the case portion has a case hardness of greater than 700 HV; and the core portion has a core hardness of greater than 360 HV.

14. The method according to claim 11, wherein after solution carburizing at 1100° C. for 1 hour to 8 hours and plasma nitriding at a temperature of 450° C. to 550° C., the case portion includes 0.3-0.5 wt % carbon and 0.4-1.0 wt % nitrogen, and has a case hardness of greater than 1000 HV.

15. The method according to claim 11, wherein after solution carburizing at 1000° C. to 1100° C. for 1 hour to 8 hours and plasma nitriding at a temperature of 450° C. to 550° C., the case portion includes a case microstructure including a fully-lath martensite matrix with strengthening precipitates including AlN, $Cr_2N$, $M_2(C,N)$ and body centered cubic copper phases;

the case portion has a hardness of greater than 1000 HV;

the core portion has a core microstructure including a fully-lath martensite matrix with strengthening precipitates including $M_2C$ and body centered cubic copper phases; and the core portion has a hardness of greater than 360 HV.

16. The method according to claim 15, the alloy comprises, by weight percentage:

3.5% to 5.5% chromium;

0.02% to 3.0% molybdenum;

0.2% to 0.5% vanadium;

1.5% to 2.0% copper;

0.8% to 1.5% nickel;

0.2% to 0.4% manganese;

0.01% to 0.05% niobium;

0.3% to 0.8% aluminum and no more than about 1.0% nitrogen.

17. The method according to claim 11, further comprising forming an article of manufacture including the alloy.

18. The method according to claim 17, the manufactured article is a gear.

19. The method according to claim 11, wherein a ratio of Ni to Cu is about 0.5.

* * * * *